US006425401B1

(12) United States Patent
Williams

(10) Patent No.: US 6,425,401 B1
(45) **Date of Patent: *Jul. 30, 2002**

(54) METHOD OF TREATING TOBACCO TO REDUCE NITROSAMINE CONTENT, AND PRODUCTS PRODUCED THEREBY

(75) Inventor: Jonnie R. Williams, Manakin-Sabot, VA (US)

(73) Assignee: Regent Court Technologies LLC, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/668,144

(22) Filed: Sep. 25, 2000

Related U.S. Application Data

(63) Continuation of application No. 09/397,018, filed on Sep. 15, 1999, now Pat. No. 6,202,649, which is a continuation-in-part of application No. 08/998,043, filed on Dec. 23, 1997, now abandoned, which is a continuation-in-part of application No. 08/879,905, filed on Jun. 20, 1997, now Pat. No. 6,135,121, which is a continuation-in-part of application No. 08/757,104, filed on Dec. 2, 1996, now Pat. No. 5,803,081.

(60) Provisional application No. 60/100,372, filed on Sep. 15, 1998.

(51) Int. Cl.[7] ..... A24B 1/02

(52) U.S. Cl. ..... 131/303; 131/290; 131/296; 131/300; 131/302

(58) Field of Search ..... 131/290, 296, 131/300, 302, 303

(56) References Cited

U.S. PATENT DOCUMENTS

| | | |
|---|---|---|
| 514,370 A | 2/1894 | Knott |
| 1,017,713 A | 2/1912 | Vaughan |

(List continued on next page.)

FOREIGN PATENT DOCUMENTS

| | | |
|---|---|---|
| CA | 1026186 | 2/1978 |
| DE | 1767677 | 6/1968 |
| DE | 3904169 A1 | 8/1990 |
| GB | 706052 | 3/1954 |
| GB | 1484663 | 2/1975 |
| GB | 2 064 294 A | 6/1981 |
| GR | 86.2434 | 10/1986 |
| WO | WO 94/07382 | 4/1994 |

OTHER PUBLICATIONS

Supplementary European Search Report, EP 99 94 8191, dated Nov. 29, 2001.

H. R. Burton et al., "Influence of Temperature and Humidity on the Accumulation of Tobacco–Specific Nitrosamines in Stored Burley Tobacco", J. Agric. Food Chem., 1989, 37, pp. 1372–1377.

Abstract, "Treatment of Organic Materials", Research Disclosure, No. 29139, Jul. 1988, XP000054259, New York, NY.

(List continued on next page.)

*Primary Examiner*—Michael Colaianni
(74) *Attorney, Agent, or Firm*—Banner & Witcoff, Ltd.

(57) ABSTRACT

A method of treating tobacco to reduce the content of, or prevent formation of, harmful nitrosamines which are normally found in tobacco is disclosed. The method includes the step of subjecting at least a portion of the plant, while the portion is uncured and in a state susceptible to having the amount of nitrosamines reduced or formation of nitrosamines arrested, to a controlled environment capable of providing a reduction in the amount of nitrosamines or prevention of the formation of nitrosamines, for a time sufficient to reduce the amount of or substantially prevent the formation of at least one nitrosamine, wherein the controlled environment is provided by controlling at least one of humidity, rate of temperature change, temperature, airflow, CO level, $CO_2$ level, $O_2$ level, and arrangement of the tobacco plant. Tobacco products and an apparatus for producing such tobacco products are also disclosed.

64 Claims, 1 Drawing Sheet

U.S. PATENT DOCUMENTS 1,194,351 A 8/1916 Benjamin
1,339,373 A 5/1920 Buensod
1,543,245 A 6/1925 Buensod
1,545,811 A 7/1925 Buensod
2,082,289 A 6/1937 Hodgin
2,124,012 A 7/1938 Smith, Jr.
2,134,843 A 11/1938 Rouse
2,343,345 A 3/1944 Touton
2,475,568 A 7/1949 Moore, Jr.
2,534,618 A 12/1950 Moore, Jr.
2,758,603 A 8/1956 Heljo
2,989,057 A 6/1961 Touton
3,024,792 A 3/1962 Touton
3,039,475 A 6/1962 Neukomm et al.
3,105,713 A 10/1963 Hassler
3,134,583 A 5/1964 Wilson
3,202,157 A 8/1965 Touton
3,251,620 A 5/1966 Hassler
3,394,709 A 7/1968 Remer
3,494,723 A 2/1970 Gray
3,494,724 A 2/1970 Gray
3,503,137 A * 3/1970 Wilson
3,664,034 A 5/1972 Wilson
3,699,976 A 10/1972 Abe et al.
3,773,055 A 11/1973 Sturgis et al.
3,785,384 A 1/1974 Sylvester et al.
3,845,774 A 11/1974 Tso et al.
3,870,053 A 3/1975 Heitkamp et al.
3,877,468 A 4/1975 Lichtneckert et al.
3,899,836 A 8/1975 Johnson
3,901,248 A 8/1975 Lichtneckert et al.
3,927,683 A 12/1975 Wilson
3,937,227 A 2/1976 Azumano
4,114,288 A 9/1978 Fowler
4,156,431 A 5/1979 Epstein et al.
4,178,946 A 12/1979 Knight
4,192,323 A 3/1980 Horne
4,206,554 A 6/1980 Fowler
4,212,634 A 7/1980 Mitchell et al.
4,247,992 A 2/1981 MacGregor
4,301,817 A 11/1981 Keritsis
4,317,837 A 3/1982 Kehoe et al.
4,355,648 A 10/1982 Bokleman et al.
4,364,401 A 12/1982 Keritsis
4,424,024 A 1/1984 Wilson et al.
4,430,806 A 2/1984 Hopkins
4,470,422 A 9/1984 Joubert et al.
4,482,315 A 11/1984 Day
4,483,353 A 11/1984 Mitchell
4,556,073 A 12/1985 Gravely et al.
4,557,057 A 12/1985 Weiss
4,557,280 A 12/1985 Gravely et al.
4,559,956 A 12/1985 De Lange et al.
4,566,469 A 1/1986 Semp et al.
4,572,219 A 2/1986 Gaisch et al.
4,590,954 A 5/1986 Gooden
4,620,556 A 11/1986 Rosson et al.
4,622,982 A 11/1986 Gaisch et al.
4,640,299 A 2/1987 Ono
4,651,759 A 3/1987 Uydess
4,685,478 A 8/1987 Malik et al.
4,709,708 A 12/1987 Kagawa
4,709,710 A 12/1987 Gaisch et al.
4,756,317 A 7/1988 Edwards
4,788,989 A 12/1988 Nambu
4,790,335 A 12/1988 Marley et al.
4,802,498 A 2/1989 Ogren
4,805,642 A 2/1989 Rainer
4,821,747 A 4/1989 Stuhl et al.
4,836,222 A 6/1989 Livingston
4,874,000 A 10/1989 Tanol et al.
4,898,189 A 2/1990 Wochnowski
4,906,274 A 3/1990 Mattox
4,907,605 A 3/1990 Ray et al.
5,018,281 A 5/1991 Bulluck, Jr.
5,023,376 A 6/1991 Shehad et al.
5,125,420 A 6/1992 Livingston
5,127,934 A 7/1992 Mattox
5,139,035 A 8/1992 Lasch et al.
5,335,590 A 8/1994 Crump, III et al.
5,372,149 A 12/1994 Roth et al.
5,431,175 A 7/1995 Beckett et al.
5,488,962 A 2/1996 Perfetti
5,515,775 A 5/1996 Crump, III et al.
5,560,376 A 10/1996 Meiring
5,685,710 A 11/1997 Martinez Sagrera et al.
5,791,353 A 8/1998 Junemann et al.
5,803,081 A 9/1998 O'Donnell, Jr. et al.
5,810,020 A 9/1998 Northway et al.
6,202,649 B1 * 3/2001 Williams ..... 131/302
2001/0000386 A1 4/2001 Peele

OTHER PUBLICATIONS

Search Report from EP 97 93 8069 dated Oct. 14, 1999.

Declaration of Harold R. Burton, Ph.D. with Exhibits A–H as follows.

(A) Data from QD, FD, MW Sample Testing/1993 Study.

(B) Data from QD and FD Sample Testing/1994 Study.

(C) Progress Report/Undated.

(D) CORESTA Conference, Agronomy & Phytopathology Joint Meeting, Reunion Commune Des Groupes Agronomic Et Phytopathologie/Abstracts, Oxford 1995 (see Abstract on p. 5—Burton et al.).

(E) Overheads from 1995 CORESTA conference presentation by Burton, 1993 Study.

(F) Overheads from 1995 CORESTA conference presentation by Burton, 1994 Study.

(G) Wiernik et al., Effect of Air–Curing On The Chemical Composition of Tobacco/1995.

(H) Burton letter to Jonnie R. Williams.

International Search Report from PCT/US99/20909 dated Dec. 23, 1999.

C.T. MacKown et al., Tobacco–Specific N–Nitrosamines: Effect of Burley Alkaloid Isolines and Nitrogen Fertility Management, 1984 American Chemical Society, J. Agric. Food Chem. 1984, 32, 1269–1272.

H.R. Burton et al., "Changes in Chemical Composition of Burley Tobacco during Senescence and Curing. 3. Tobacco–Specific Nitrosamines", J. Agric. Food Chem., 1989, 37, pp. 426–430.

H. Ohshima et al., Identification and Occurrence of Two New N–Nitrosamino Acids in Tobacco Products: 3–(N–Nitroso–N–Methylamino) Propionic Acid and 4–(N–Nitroso–N–Methylamino) Butyric Acid, Cancer Letters, 1985, 153–162.

K. Brunnemann et al., "Analytical Studies on Tobacco–Specific N–Nitrosamines in Tobacco and Tobacco Smoke", Toxicology, Naylor Dana Institute for Disease Prevention, 1991, vol. 21, Issue 4, 235–240.

K. Brunnemann et al., "Role of Tobacco Stems in the Formation of N–Nitrosamines in Tobacco and Cigarette Mainstream and Sidestream Smoke", 1983 American Chemical society, J. Agric. Food Chem., vol. 31, No. 6, 1221–1224.

D. Hoffmann et al., "Carcinogenic Tobacco–specific N–Nitrosamines in Snuff and in the Saliva of Snuff Dippers", Cancer Research 1981, 43, 4305–4308.

S. Hecht et al., "Tobacco–Specific Nitrosamines: Formation From Nicotine in Vitro and During Tobacco Curing and Carcinogenicity in Strain A Mice", J. Natl. Cancer Inst., 1978, vol. 60, No. 4, 819–824.

H. Burton et al., "Distribution of Tobacco Constituents in Tobacco Leaf Tissue. 1. Tobacco–Specific Nitrosamines, Nitrate, Nitrite, and Alkaloids", J. Agric. Food Chem., 1992, 40, pp. 1050–1055.

H. Burton et al., "Changes in Chemical Composition of Tobacco Lamina during Senescense and Curing. 1. Plastic Pigments", J. Agric. Food Chem., 1985, 33, pp. 879–883.

Program, 44th Tobacco Chemists' Research Conference, 1990, Winston–Salem, North Carolina, pp. 32–33.

Program, 49th Tobacco Chemists' Research Conference, 1995, vol. 49, Lexington, Kentucky, p. 38.

B. Spiegelhalder, "A Method for the Determination of Tobacco–specific Nitrosamines (TSNA), Nitrate and Nitrite in Tobacco Leaves and Processed Tobacco", Beitrage zur Tabakforschung International, vol. 14, No. 3, Jan. 1989.

Program Booklet and Abstracts, 53rd Tobacco Science Research Conference, 1999, Montreal, Quebec, Canada, pp. 68–69.

S. Fischer et al., "Exposure to Tobacco specific nitrosamines by the different habits of tobacco use, examination of transfer rates and the influence of smoking habits."

D. Hoffmann et al., "Nicotine–derived N–Nitrosamines and Tobacco–related Cancer: Current Status and Future Directions", Cancer Research, 1985, vol. 45, 935–944.

S. Hecht et al. "Chemical Studies on Tobacco Smoke. XXXIII. N–Nitrosonornicotine in Tobacco: Analysis of Possible Contributing Factors and Biologic Implications", J. Natl. Cancer Inst., 1974, vol. 54, No. 5, 1237–1244.

D. Ralt et al., "The Role of Bacteria in Nitrosamine Formation", 1981 American Chemical Society, pp. 157–164.

S. Fischer et al., "Investigations on the origin of tobacco–specific nitrosamines in mainstream smoke of cigarettes", Carcinogenesis vol. 11, No. 5 pp. 723–730, 1990.

S. Fischer et al., "Tobacco–specific nitrosamines in Canadian cigarettes", J. Cancer Res. Clin. Oncol., 1990, 116, pp. 563–568.

A.R. Tricker et al., "The occurrence of N–nitroso compounds in kiwam tobacco", Cancer Letters, 49 (1989) 221–224.

S.E. Atawodi et al., "Tobacco–specific nitrosamines in some Nigerian cigarettes", Cancer Letters 97 (1995) 1–6.

Abstract, "Formation of Tobacco–Specific Nitrosamines", Critical Reviews in Toxicology, 21, No. 4, p. 241 (1991).

S. Fischer et al., "No Pyrosynthesis of N'–Nitrosonornicotine (NNN) and 4–(Methylnitrosamino)–1–(3–Pyridyl)–1–Butanone (NNK) from Nicotine", Inst. of Toxicology and Chemotherapy, German Cancer Research Center, Heidelberg, FRG.

P. Mende et al., "Occurrence of the nitrosamide precursor pyrrolidin–(2)–one in food and tobacco", Carcinogenesis vol. 15, No. 4, pp. 733–737, 1994.

Recent Advances in Tobacco Science, vol. 17, "Topics of Current Scientific Interest in Tobacco Research", Proceedings of a Symposium Presented at the 45th Meeting of the Tobacco Chemists' Research Conference, Oct. 1991, Asheville, North Carolina, pp. 71–112.

B. Spiegelhalder et al., "Tobacco–specific nitrosamines", European Journal of Cancer Prevention 1996, 5 (Supplement I), 33–38.

K. Brunnemann et al., "N–Nitrosamines in Chewing Tobacco: An International Comparison", J. Agric. Food Chem. 1955, 33, 1178–1181.

S. Fischer et al., "Preformed tobacco–specific nitrosamines in tobacco—role of nitrate and influence of tobacco type", Genesis vol. 10 No. 8, pp. 1511–1517, 1989.

W. Gondwe et al., "Screening Tobacco Types, Cultivars and Curing Methods for Low Nitrosamine Tobacco Production in Malawi", Agricultural Research and Extension Trust, 1996 Coresta Congress at Yokohama, Japan, Nov. 1996.

S. Fischer et al., "Tobacco–specific nitrosamines in European and USA cigarettes", Arch. Geschwulstforsch, 60 (1990) Heft. 3.

D. Hoffmann et al., "The Role of Volatile and Nonvolatile N–Nitrosamines in Tobacco Carcinogenesis", Naylor Dana Inst. for Disease Prevention, American Health Foundation, Valhalla, New York.

M. Dixon et al., "Enzymes", Second Edition, American Press, New York, 1964, pp. 144–151.

World Agriculture Series, Tobacco Production, Chemistry and Technology, pp. 129 and 132.

Recent Advances in Tobacco Science, vol. 21, "Impact of Plant Manipulation and Post Harvest Phenomena on Leaf Composition", Symposium Proceedings 49th Meeting Tobacco Chemists' Research Conference, Sep. 24–27, 1995, Lexington, Kentucky, pp. 3–81.

H. Burton et al., "Relationship between Tobacco–Specific Nitrosamines and Nitrite from Different Air–Cured Tobacco Varieties", J. Agric. Food Chem., 1994, 42, pp. 2007–2011.

Information Bulletin, Cooperation Centre for Scientific Research Relative to Tobacco (CORESTA), 1991–2, Abstr.–Ref. 6210–6646.

Letter from Paul L. Perito to Dr. Bertold Spiegelhalder dated Apr. 2, 2001.

Email communication from Dr. Bertold Spiegelhalder to Paul L. Perito dated May 31, 2001.

A.R. Tricker et al., "The occurrence of N–nitro compounds in zarda tobacco", Cancer Letters, 42 (1988) 113–118.

S.S. Hecht, "Biochemistry, Biology, and Carcinogenicity of Tobacco–Specific N–Nitrosamines", Chemical Research in nToxicology, Jun. 1998, vol. 11, No. 6: 559–603.

S.V. Bhide et al., "Tobacco–specific N–Nitrosamines [TSNA] in Green Mature and Processed Tobacco Leaves from India", Beitrage zur Tabakforschung International, vol. 14, No. 1, Dec. 1987.

B.K. Larsson et al., "Polycyclic Aromatic Hydrocarbons and Volatile N–Nitrosamines in Some Dried Agricultural Products", Swedish J. agric. Res. 49–56, 1990.

T.C.Tso et al, "Some Agronomic Factors Affecting N–Dimethyl–nitrosamine Content in Cigarette Smoke", Beitrage zur Tabakforschung, Band 8, Heft 1, Januar 1975.

J.L. Hamilton et al., "Nitrate Concentration Changes During Senescence and Air Curing of Burley Tobacco", Tobacco Science, XXVI:pp. 133–137; Tobacco International, vol. 184, No. 24, pp. 44–48.

Technology Agriculture, 1995, pp. 146–148.

M.V. Djordjevic et al., "Tobacco–Specific Nitrosamine Accumulation and Distribution in Flue–Cured Tobacco Alkaloid Isolines", J. Agric.Food Chem 1989, 37, 752–756.

G. Stehlik et al., "Concentration of Dimethylnitrosamine in the Air of Smoke–Filled Rooms", Ecotoxicology and Environmental Safeety 6. 495–500 (1982).

R.A. Andersen et al., "Effects of Air–Curing Environment on Alkaloid–Derived Nitrosamines in Burley Tobacco", U.S. Department of Agriculture and College of Agriculture, University of Kentucky, Lexington, KY, pp. 451–455.

R.A. Scanlan et al., "N–Nitrosodimethylamine in Nonfat Dry Milk", Chapter 3, 1994 Am. Chem. Soc.

ACS Symposium Series, "Nitrosamines and Related N–Nitroso Compounds", 204th National Meeting of the American Chemical Society, Washington, D.C., Aug. 23–28, 1992.

Abstract, M. Cui et al., "Factors in Tobacco–Specific n–Nitrosamine Accumulation in Tobacco", University of Kentucky, 1996.

Abstract, P.D. Legg et al., "Nitrogenous Constituents in Dark Air–Cured and Fire–Cured Cultivars", University of Kentucky; USDA/Georgia, 1986.

S.V. Bhide et al., "Tobacco Specific N–Nitrosamines in Green Mature Tobacoo Leaves and its Progressive Increase on Drying and Processing".

R.A. Andersen et al., Changes in Chemical Composition of Homogenized Leaf–Cured and Air–Cured Burley Tobacco Stored in Controlled Environments, 1982 American Chemical Society, J. Agric. Food Chem. 1982, 30, 663–668.

C.T. MacKown et al., Tobacco–Specific N–Nitrosamines: Formation During Processing of Midrib and Lamina Fines, 1988 American Chemical Society, J. Agric. Food Chem. 1988, 36, 1031–1035.

R.A. Andersen et al., Accumulation of 4–(N–Methyl–N–nitrosamino)–1–(3–pyridyl)–1–butanone in Alkaloid Genotypes of Burley Tobacco during Postharvest Processing: Comparisons with N'–Nitrosonornicotnie and Probable Nitrosamine Precursors, Cancer Research vol. 45, Nov. 1985, pp. 5287–5293.

W.J. Chamberlain et al., Effects of Curing and Fertilization on Nitrosamine Formation in Bright and Burley Tobacco, Phytochemical Research Unit, USDA, Agricultural Research Service, Beitrage zur Tabakforschung International, vol. 15, No. 2, Apr. 1992.

C. Mingwu et al., Effect of Maleic Hydrazide Application on Accumulation of Tobacco–Specific Nitrosamines in Air-Cured Burley Tobacco, J. Agric. Food (1994), 42(12), 2912–16.

W.J. Chamberlain et al., Studies on the Reduction of Nitrosamines in Tobacco, Tobacco International, (1986) vol. 188, No. 16, pp. 38–39.

Q. Qungang, Changes In Tobacco–Specific Nitrosamines, Alkaloids, Nitrate, Nitrite and Lamina Leachate Conductivity of Dark Tobacco During Curing, Bulletin d'Information—Coresta, (1991) No. 2, pp. 7–22.

C. Mingwu, The Source and the Regulation of Nitrogen Oxide Production for Tobacco–Specific Nitrosamine Formation During Air–Curing, University of Kentucky, Lexington, (1998) 178pp. Avail., :UMI, Order No. DA9907718 From: Diss. Abstr. Int., B 1999, 59(9), 4548 Dissertation.

W.J. Chamberlain et al., Levels of N–nitrosonornicotine in Tobaccos Grown Under Varying Agronomic Conditions, Tobacco International, (1984) vol. 186, No. 26, pp. 111–113.

Defendant R. J. Reynolds Tobacco Company's Amended and Supplemeental Responses to Plaintiff's First Set of Interrogatories, filed in the U. S. District Court of Maryland, Civil Action 01–1504, dated Feb. 22, 2002, 23 pages.

W. S. Schlotzhauer and O. T. Chortyk, Changes in the Chemical Composition of NC 2326 Tobacco Through Ozone Treatment of Intact Leaves, 2 sheets, Oct. 1986.

Dietrich Hoffmann, Abraham Rivenson, Fung–Lung Chung, and Stephen S. Hecht, "Nicotine–Derived N–Nitrosamines (TSNA) and Their Relevance in Tobacco Carcinogenesis", pp. 305–311, vol. 21, Issue 4, 1991.

Joe M. Bunn, George A. Duncan, Wiley H. Henson, Jr. And Linus R. Walton, "Environmental Design of a New Burley Curing Barn", (Tobacco Science 1–5), 3 sheets, Jun. 22, 1972.

Walter G. Frankenburg, "Chemical Changes in the Harvested Tobacco Leaf", pp. 326–425, (date unknown).

W. H. Johnson, "Oxygen Depletion By Respiration For Bright Leaf Tobacco In A Closed Curing System", (Tobacco Science 5–11), 4 sheets, (date unknown).

C,W, Suggs, "Mechanical Harvesting Of Flue–Cured Tobacco: Part 10: Optimization of Curing Capacity and Bulk Barn Parameters", (Tobacco Science 126–130), 3 sheets, May 2, 1979.

C,W, Suggs, "Mechanical Harvesting Of Flue–Cured Tobacco: Part 9: Developments in Container (Box) Bulk Curing", (Tobacco Science 1–6), 3 sheets, Jul. 18, 1978.

Bryan W. Maw, Paul E. Sumner and Michael G. Stephenson, "Tobacco Qulaity As Affected By Fan Cycling During Different Stages of Tobacco Curing", Tobacco Science 116–118), 3 sheets, vol. 30, 1986.

Abstract Form, 41st Tobacco Chemists' Research Conference, Greensboro, NC, 1 sheet, 1987.

FD. Chem. Toxic., "Short Paper Tobacco—Specific N—Nitrosamines In Dry Snuff", vol. 25, No. 3, pp. 245–246, 1987.

R. T. Garvin, "How Prolonged Yellowing Affects the Dry—Mass Yield And Chemical Constituents of Flue–Cured Tobacco", (Tobacco Science 13–15), 2 sheets, May 2, 1986.

A. R. Tricker, R. Haubner, B. Spiegelhalder and R. Preussmann, "The Occurrence of Tobacco–Specific Nitrosamines In Oral Tobacco Products and Their Potential Formation Under Simulated Gastric Conditions", Fd. Chem. Toxic. vol. 26. No. 10, pp. 861–865, 1988.

Ventobacco, Bulk Curing Barns, Operator's Manual, 18 sheets, Poland 1993.

Ventobacco, Curing Computer VK 961, Operator's Manual, 20 pages, 1997.

Ventobacco, Ventolab 6, Operator's Manual, 3 sheets, Cyprus 1992.

Ventobacco, 84 Rack Curing Barn, 8 sheets, Jordan 1992.

Ventobacco, Curing Computer VK 981, Operator's Manual, 29 pages, 1998.

Group Research and Development Centre, "The Effect of Curing Techniques on the Nitrosamine Content of Tobacco: A Preliminary Study", 13 sheets, Oct. 13, 1983.

W. J. Chamberlain, O. T. Choritk, J. L. Baker and T. G. Sutton, "Curing Effects on Contents of Tobacco Specific Nitrosamines In Bright and Burley Tobaccos," 11 sheets, 1986.

Research and Development Centre, "The Effect of Agricultural and Curing Practices on Nitrosamine Levels in Tobacco," 42 sheets, Nov. 6, 1986.

Research and Development Centre, "Nitrosamine Reduction By Tobacco Irradiation," 22 sheets, Mar. 1, 1989.

S. Makleit, Abstract Translation, "Nitrosamines in Tobacco and In Cigarette Smoke," 13 sheets, 1986/.

J. S. Cundiff, "Fan Cycling and Energy Consumption in Bulk Tobacco Curing," pp. 3–29, 1978.

C. W. Suggs, H. B. Peel and T. R. Seaboch, "Bulk Density and Drying Effect on Air Flow Through Flue–Cured Tobacco Leaves," Tob. Sci. 33, pp. 86–90, 1989.
William H. Johnson, "Influence of Harvesting and Process Variables on Bulk Curing Of Bright Leaf Tobacco," Translations of the ASAE, vol. 8, No. 3, pp. 354–357, 1965.
M. D. Boyette and C. W. Suggs, "Flue–Cured Tobacco," 3 sheets, 1992.
George A. Duncan, "Using Fans in Conventional Burley Barns," 3 sheets, Apr. 1992.
Charles H. Risner and Fred N. Wendelboe, "Quantification of Tobacco Specific Nitrosamines In Tobacco," 3 sheets, Jan. 1994.
Defendant R. J. Reynolds Tobacco Company's Responses to Plaintiff's First Set of Interrogatories, *Star Scientific, Inc. v. R. J. Reynolds Tobacco Company*, Civil Action AW–01–1504 (U.S. District Court Maryland), Dec. 24, 2001.

* cited by examiner

METHOD OF TREATING TOBACCO TO REDUCE NITROSAMINE CONTENT, AND PRODUCTS PRODUCED THEREBY

CROSS-REFERENCE TO RELATED APPLICATIONS

This application is a continuation of application Ser. No. 09/397,018, filed Sep. 15, 1999, now U.S. Pat. No. 6,202,649, is based on U.S. Provisional Application No. 60/100,372, filed Sep. 15, 1998, and which is a continuation-in-part of U.S. application Ser. No. 08/998,043, filed Dec. 23, 1997, now abandoned, which in turn is a continuation-in-part of U.S. application Ser. No. 08/879,905, filed Jun. 20, 1997, now U.S. Pat. No. 6,135,121, which in turn is a continuation-in-part of Ser. No. 08/757,104, filed Dec. 2, 1996 and now U.S. Pat. No. 5,803,081 issued to Jonnie R. Williams on Sep. 8, 1998. U.S. Provisional Application No.60/100,372 filed on Sep. 15, 1998, U.S. application Ser. No. 08/998,043 now abandoned and Ser. No. 08/879,905, now U.S. Pat. Nos. 6,135,121 and 5,803,081 are all incorporated herein by reference in their entirety.

FIELD OF THE INVENTION

The present invention relates to an improved method of treating tobacco to reduce the content of, or to prevent the formation of, harmful nitrosamines, which are normally found in tobacco. The present invention also relates to tobacco products having low nitrosamine content.

BACKGROUND OF THE INVENTION

Prior attempts to reduce tar and harmful carcinogenic nitrosamines primarily have included the use of filters in smoking tobacco. In addition, attempts have been made to use additives to block the effects of harmful carcinogens in tobacco. These efforts have failed to reduce the oncologic morbidity associated with tobacco use. It is known that fresh-cut, green tobacco has virtually no nitrosamine carcinogens. See, e.g., Wiernik et al, "Effect of Air-Curing on the Chemical Composition of Tobacco," Recent Advances in Tobacco Science, Vol. 21, pp. 39 et seq., Symposium Proceedings 49th Meeting Tobacco Chemists' Research Conference, Sep. 24–27, 1995, Lexington, Ky. (hereinafter "Wiernik et al."). On the other hand, cured tobacco products obtained according to conventional methods are known to contain a number of nitrosamines, including the harmful carcinogens N'-nitrosonornicotine (NNN) and 4-(N-nitrosomethylamino)-1-(3-pyridyl)-1-butanone (NNK). It is widely accepted that such nitrosamines are formed post-harvest, during the conventional curing process, as described further herein. Unfortunately, fresh-cut green tobacco is unsuitable for smoking or other consumption.

It is believed that tobacco-specific nitrosamines (TSNAs) are formed primarily during the curing process. While not wishing to be bound by theory, it is believed that the amount of tobacco-specific nitrosamine (TSNA) in cured tobacco leaf is dependent on the accumulation of nitrites, which accumulate during the death of the plant cell and are formed during curing by the reduction of nitrates under conditions approaching an anaerobic (oxygen deficient) environment. It is believed that the reduction of nitrates to nitrites occur by the action of the micro flora on the surface of the leaf under anaerobic conditions, and it is also believed that this reduction is particularly pronounced under certain conditions (e.g., humid conditions). Furthermore, during the curing process, the tobacco leaf emits carbon dioxide, which can further dilute oxygen levels in the environment.

Once the nitrites are formed, these compounds are believed to combine with various tobacco alkaloids, including pyridine-containing compounds, to form carcinogenic nitrosamines.

In 1993 and 1994, Burton et al at the University of Kentucky carried out certain experiments regarding TSNA, as reported in the Abstract, "Reduction of Nitrite-Nitrogen and Tobacco N'-Specific Nitrosamines In Air-Cured Tobacco By Elevating Drying Temperatures," Agronomy & Phytopathology Joint Meeting, CORESTA, Oxford 1995. Burton et al reported that drying harvested tobacco leaves for 24 hours at 71° C., at various stages of air curing, including end of yellowing (EOY), EOY+3, EOY+5, etc. resulted in some reduction of nitrosamine levels. Reference is also made to freeze drying and microwaving of certain samples, without detail or results. It has been confirmed that in the actual work underlying this Abstract, carried out by Burton et al at the University of Kentucky, the microwave work was considered unsuccessful. Certain aspects of Burton et al's 1993–94 study are reported in Wiernik et al, supra, at pages 54–57, under the heading "Modified Air-Curing." The Wiernik et al article postulates that subjecting tobacco leaf samples, taken at various stages of air-curing, to quick-drying at 70° C. for 24 hours, would remove excess water and reduce the growth of microorganisms; hence, nitrite and tobacco-specific nitrosamine (TSNA) accumulation would be avoided. In Table II at page 56, Wiernik et al includes some of Burton et al's summary data on lamina and midrib nitrite and TSNA contents in the KY160 and KY171 samples. Data from the freeze-drying and the quick-drying tests are included. The article contains the following conclusion:

> It can be concluded from this study that it may be possible to reduce nitrite levels and accumulation of TSNA in lamina and midrib by applying heat (70° C.) to dark tobacco after loss of cell integrity in the leaf. Drying the tobacco leaf quickly at this stage of curing reduces the microbial activity that occurs during slow curing at ambient temperature. It must be added, however, that such a treatment lowers the quality of the tobacco leaf.

Id. at page 56. The Wiernik et al article also discusses traditional curing of Skroniowski tobacco in Poland as an example of a 2-step curing procedure. The article states that the tobacco is first air-cured and, when the lamina is yellow or brownish, the tobacco is heated to 65° C. for two days in order to cure the stem. An analysis of tobacco produced in this manner showed that both the tobacco-specific nitrosamine (TSNA) and the nitrite contents were low, i.e., in the range of 0.6–2.1 micrograms per gram and less than 10 micrograms per gram, respectively. Wiernik et al theorized that these results were explainable due to the rapid heating which does not allow further bacterial growth. Wiernik et al also noted that tobacco-specific nitrosamine (TSNA) and nitrite contents of 0.2 microgram per gram and less than 15 micrograms per gram, respectively, were obtained for tobacco subjected to air-curing in Poland.

In practice, tobacco leaves are generally cured according to one of three methods. First, in some countries, such as China, a variation of the flue curing process (described below) is still being used on a commercial scale to cure tobacco leaves. Specifically, this variation of the flue curing process features the use of a heat exchanger and involves the burning of fuel and the passing of heated air through flue pipes in a curing barn. Accordingly, in this older version of the curing process, primarily radiant heat emanating from the flue pipes is used to cure the tobacco leaves. While a relatively low flow of air does pass through the curing barn, this process utilizes primarily radiant heat emanating from the flue pipes to cure the tobacco leaves within the barn. In addition, this process does not appreciate, and does not provide for, controlling the conditions within the barn to achieve prevention or reduction of TSNAs. This technique has been largely replaced in the United States by a different flue-curing process.

For more than twenty years, the heat exchanger method described above has been supplanted in the U.S. with a more economical version which features the use of a propane burner. This second method is the so-called "flue curing" method. This process involves placing the tobacco leaves in a barn and subjecting the leaves to curing with the application of convective heat using a hot gaseous stream that includes combustion exhaust gases. When convective heat is used to dry the tobacco leaves, the combustion exhaust gases (including carbon monoxide, carbon dioxide, and water) are passed directly through the tobacco. In processes where convective heat is used for curing, no attempt is made to separate the heat from the combustion exhaust gases (i.e., to prevent an anaerobic condition) or to control the ambient conditions to reduce or suppress the formation of TSNAs.

The third method is known as "air curing." This process involves placing the tobacco leaves in a barn and subjecting the leaves to air curing without controlling the ambient conditions (e.g., air flow through the barn, temperature, humidity, and the like) and without the application of any heat.

U.S. Pat. No. 2,758,603 to Heljo discloses a process for treating tobacco with relatively low moisture levels (i.e., already cured tobacco) with radio frequency energy to accelerate the aging process. Although the patent states that the tobacco being treated is "green" tobacco, it is clear that the patent is using the term "green" in a non-conventional sense because the tobacco being treated therein is already cured (i.e., the tobacco is already dried). This is clearly evident from the disclosed moisture levels for the tobacco being treated in the Heljo patent. In fact, Heljo rehydrates the fully cured tobacco prior to the radio frequency treatment. By contrast, in the present invention, the term "green tobacco" refers to freshly harvested tobacco, which contains relatively high levels of moisture.

Additionally, the use of microwave energy to dry agricultural products has been proposed. For example, use of microwave energy to cure tobacco is disclosed in U.S. Pat. No. 4,430,806 to Hopkins. Further, U.S. Pat. No. 4,898,189 to Wochnowski teaches the use of microwaves to treat green tobacco in order to control moisture content in preparation for storage or shipping. In U.S. Pat. No. 3,699,976, microwave energy is described to kill insect infestation of tobacco. Still further, techniques using impregnation of tobacco with inert organic liquids (U.S. Pat. No. 4,821,747) for the purposes of extracting expanded organic materials by a sluicing means have been disclosed wherein the mixture was exposed to microwave energy. In another embodiment, microwave energy is disclosed as the drying mechanism of extruded tobacco-containing material (U.S. Pat. No. 4,874,000). In U.S. Pat. No. 3,773,055, Sturgis discloses the use of microwave to dry and expand cigarettes made with wet tobacco.

Using a novel breakthrough curing technology, U.S. Pat. No. 5,803,081 to Williams discloses a method of reducing the nitrosamine levels or preventing the formation of nitrosamines in a harvested tobacco plant using microwave energy.

In copending U.S. patent application Ser. No. 08/879,905, filed Jun. 20, 1997, a process for reducing the amount of or preventing the formation of nitrosamines in harvested tobacco plant is disclosed, wherein the process comprises subjecting at least a portion of the plant to microwave radiation, while the portion is uncured and in a state susceptible to having the amount of nitrosamines reduced or formation of nitrosamines arrested, for a time sufficient to reduce the amount of, or substantially prevent formation of, at least one nitrosamine.

Further, copending U.S. patent application Ser. No. 08/998,043, filed Dec. 23, 1997, discloses that microwave and other types of radiation are useful for treating tobacco to reduce the amount of, or prevent the formation of, nitrosamines in tobacco.

SUMMARY OF THE INVENTION

Figure 1:
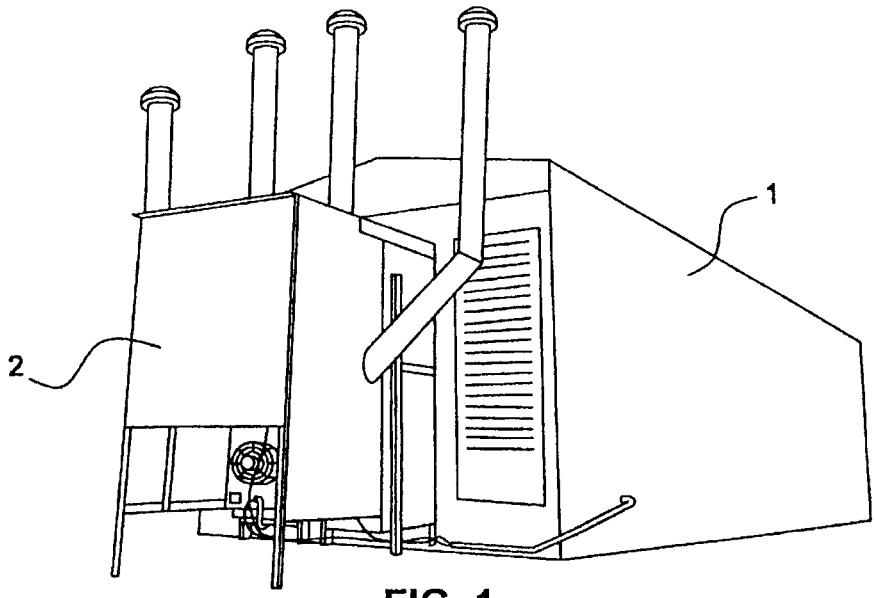
FIG. 1 illustrates a tobacco-curing apparatus according to the present invention.

It has now been discovered that by controlling the conditions to which tobacco leaves are subjected to within the curing barn during the curing process, the formation of TSNAs in the tobacco product can be prevented or reduced. The parameters that can be varied to control the conditions within the curing barn (or curing apparatus) during the curing process include humidity, rate of temperature change, temperature, the time of treatment of the tobacco, the airflow (through the curing apparatus or barn), CO level, $CO_2$ level, $O_2$ level, and the arrangement of the tobacco leaves.

By controlling the conditions during the curing process within certain parameters, it is believed that it is now possible to prevent or reduce the formation of microbes capable of causing the formation of TSNAs in the tobacco. Thus, under the conditions contemplated for the present invention, it is believed that there would be little or no nitrites available for the formation of TSNAs by reaction of the nitrites with various tobacco alkaloids. For example, it is postulated that if the conditions are made aerobic, the microbes will consume the oxygen in the atmosphere for their energy source, and therefore no nitrites will form. Further, it is believed that the microbes are "obligate" anaerobes, and thus when they are subjected to certain conditions, they will be suppressed and cannot participate in the formation of nitrites.

Accordingly, one object of the present invention is to substantially eliminate or reduce the content of nitrosamines in tobacco intended for smoking or consumption by other means.

Another object of the present invention is to reduce the carcinogenic potential of tobacco products, including cigarettes, cigars, chewing tobacco, snuff and tobacco-containing gum and lozenges.

Still another object of the present invention is to substantially eliminate or significantly reduce the amount of tobacco-specific nitrosamines, including N'-nitrosonornicotine (NNN), 4-(N-nitrosomethylamino)-1-(3-pyridyl)-1-butanone (NNK), N'-nitrosoanatabine (NAT) and N'-nitrosoanatabine (NAB), in such tobacco products.

Another object of the present invention is to treat uncured tobacco at an appropriate time post-harvest so as to arrest the curing process without adversely affecting the tobacco's suitability for human consumption.

Another object of the present invention is to reduce the content of tobacco-specific nitrosamines by treating uncured tobacco in a controlled environment.

Yet another object of the present invention is to reduce the content of tobacco-specific nitrosamines, particularly NNN and NNK, and metabolites thereof in humans who smoke, consume or otherwise ingest tobacco in some form, by providing a tobacco product suitable for human consumption, which product contains a substantially reduced quantity of tobacco-specific nitrosamines, thereby lowering the carcinogenic potential of such product. The tobacco product may be a cigarette, cigar, chewing tobacco or a tobacco-containing gum or lozenge.

Yet another object is to provide a novel curing barn (or curing apparatus) which is capable of providing tobacco suitable for human consumption, wherein the tobacco contains relatively low levels to zero tobacco-specific nitrosamines.

In one embodiment, the above and other objects and advantages in accordance with the present invention can be obtained by a process for reducing the amount of or preventing the formation of nitrosamines in a harvested tobacco plant, comprising subjecting at least a portion of the plant, while said portion is uncured and in a state susceptible to having the amount of nitrosamines reduced or formation of nitrosamines arrested, to a controlled environment capable of providing a reduction in the amount of nitrosamines or prevention of the formation of nitrosamines, for a time sufficient to reduce the amount of or substantially prevent the formation of at least one nitrosamine, wherein said controlled environment is provided by controlling at least one of humidity, rate of temperature change, temperature, airflow, CO level, $CO_2$ level, $O_2$ level, and the arrangement of the tobacco leaves.

In a preferred embodiment of the invention, the step of subjecting tobacco leaf to the controlled environment is carried out on a tobacco leaf or portion thereof after onset of yellowing in the leaf and prior to substantial accumulation of tobacco-specific nitrosamines in the leaf It is also preferred that in the process of the invention, the step of subjecting the tobacco leaf to the controlled environment is carried out prior to substantial loss of the leafs cellular integrity.

It is also preferred in accordance with the present invention that the tobacco leaf or a portion thereof is subjected to the controlled environment for a time sufficient to effectively dry the leaf, without any charring when heat is applied, so that it is suitable for human consumption.

The present invention also seeks to subject tobacco leaves to the controlled environment to prevent normal accumulation of at least one tobacco-specific nitrosamine, such as N'-nitrosonornicotine, 4-(N-nitrosomethylamino)-1-(3-pyridyl)-1-butanone, N'-nitrosoanatabine and N'-nitrosoanatabine.

In another embodiment, the process of the invention further comprises treating the tobacco leaves, while in a state susceptible to having the content of at least one TSNA prevented or reduced, to microwave energy or other forms of high energy treatment.

The present invention in its broadest forms also encompasses a tobacco product comprising non-green tobacco suitable for human consumption and having a lower content of at least one tobacco-specific nitrosamine than conventionally cured tobacco.

In another embodiment, the present invention relates to a novel curing barn which is capable of providing a controlled environment in which the formation of tobacco-specific nitrosamines can be prevented or reduced.

DETAILED DESCRIPTION OF THE INVENTION

For purposes of the invention, the phrase "controlling the conditions" means determining and selecting an appropriate humidity, rate of temperature change, temperature, time of treatment of the tobacco, airflow, CO level, $CO_2$ level, $O_2$ level, and arrangement of the tobacco leaves to prevent or reduce the formation of at least one TSNA. For a given set of ambient conditions, it may be necessary to adjust, within the curing apparatus or barn, one or more of these parameters. For example, it is possible to prevent or reduce the formation of TSNAs by simply setting a high airflow through the curing apparatus or barn. In other situations, it is possible to produce the tobacco products of the present invention with low airflow, provided that other parameters such as humidity, temperature, etc. are appropriately selected.

In this disclosure, tobacco that has been "conventionally cured" is tobacco that has been air-cured or flue-cured, without the controlled conditions described herein, according to conventional methods commonly and commercially used in the U.S.

Further, the term "green tobacco" means tobacco that is substantially uncured and is particularly inclusive of freshly harvested tobacco.

In flue curing processes that utilize a heat exchanger capable of providing relatively low airflow through the curing barn, I have discovered that it is possible to somewhat reduce the TSNA levels by not venting combustive exhaust gases into the curing apparatus or barn. The preferred aspects of the present invention are premised on the discovery that other parameters, as identified above (e.g., airflow), can be adjusted to ensure the prevention or reduction of at least one TSNA regardless of the ambient conditions. Thus, even under the most extreme conditions (i.e., conditions that enhance the formation of TSNAs), it is possible to achieve the prevention or reduction of at least one TSNA.

It has been said that the practice of tobacco curing is more of an art than a science, because curing conditions during any given cure must be adjusted to take into account such factors as variety differences, differences in leaves harvested from various stalk positions, differences among curing barns in terms of where they are used, and environmental variations during a single season or over multiple seasons, especially in terms of weather fluctuations during air-curing. For example, the practice of flue curing is empirical to a certain degree, and is optimally carried out by individuals who have accumulated experience in this art over a significant period of time. See, e.g., Peele et al, "Chemical and Biochemical Changes During The Flue Curing Of Tobacco," Recent Advances In Tobacco Science, Vol. 21, pp. 81 et seq., Symposium Proceedings 49th Meeting Chemists' Research Conference, Sep. 24–27, 1995, Lexington, Ky. (hereinafter "Peele et al"). Thus, one of ordinary skill in the art of tobacco curing would understand that the outer parameters of the present invention, in its broadest forms, are variable to a certain extent depending on the precise confluence of the above factors for any given harvest.

In one embodiment, the present invention is founded on the discovery that a window exists during the tobacco curing cycle, in which the tobacco can be treated in a manner that will essentially prevent the formation of TSNA. Of course, the precise window during which TSNA formation can be effectively eliminated or substantially reduced depends on the type of tobacco and a number of other variables, including those mentioned above. In accordance with this embodiment of the present invention, the window corresponds to the time frame post-harvest when the leaf is beyond the fresh-cut or "green" stage, and prior to the time at which TSNAs and/or nitrites substantially accumulate in the leaf. This time frame typically corresponds to the period in which the leaf is undergoing the yellowing process or is in the yellow phase, before the leaf turns brown, and prior to the substantial loss of cellular integrity. (Unless otherwise clear from the context, the terms "substantial" and "significant" as used herein generally refer to predominant or majority on a relative scale, give or take.) During this time frame, the leaves are susceptible to having the formation of TSNAs substantially prevented, or the content of any already formed TSNA reduced, by subjecting the tobacco to a controlled environment capable of providing a reduction in the amount of nitrosamines or prevention of the formation of nitrosamines, for a time sufficient to reduce the amount of or substantially prevent the formation of at least one nitrosamine, wherein said controlled environment is provided by controlling at least one of humidity, rate of temperature change, temperature, airflow, CO level, $CO_2$ level, $O_2$ level, and arrangement of the tobacco leaves. This treatment of the tobacco essentially arrests the natural formation of TSNAs, and provides a dried, golden yellow leaf suitable for human consumption. If TSNAs have already begun to substantially accumulate, typically toward the end of the yellowing phase, the treatment according to the present invention effectively arrests the natural TSNA formation cycle, thus preventing any further substantial formation of TSNA. When yellow or yellowing tobacco is treated in this fashion at the most optimal time in the curing cycle, the resulting tobacco product has TSNA levels essentially approximating those of freshly harvested green tobacco, while maintaining its flavor and taste. In addition, the nicotine content of the tobacco product according to the present invention remains unchanged, or is substantially unchanged, by the treatment according to the present invention. Accordingly, th e tobacco product of the present invention has relatively low contents of TSNAs, and yet the user of the tobacco product can experience the same sensations that are obtainable from using conventional tobacco products.

As discussed above, it is believed that tobacco-specific TSNAs are formed primarily during the curing process. Specifically, it is believed that the amount of TSNAs in cured tobacco leaf is dependent on the accumulation of nitrites, which are formed during the curing process by reduction of nitrates to nitrites under conditions approaching an anaerobic (i.e., oxygen deficient) environment. The nitrites accumulate during the death of the plant cell. Experimental evidence suggests that the nitrites are formed by the micro flora on the surface of the leaf under conditions approaching an anaerobic environment. If, for example, conditions are made aerobic, the microbes will consume the oxygen in the atmosphere for their energy source, and thus, no nitrites will form. Once nitrites are formed, however, they can then combine with various tobacco alkaloids, including pyridine-containing compounds, to form carcinogenic substances such as nitrosamines.

In one conventional curing technique, the combustion exhaust gases pass through the tobacco, thereby creating a condition approaching an anaerobic environment. This conventional curing technique utilizes air that is normally recirculated within the curing barn and is often air having high humidity. Conventional curing has been developed over time without any appreciation for subjecting tobacco to a controlled environment for the purpose of eliminating or reducing TSNAs. Accordingly, such conventional curing techniques do not provide suitable conditions (e.g., adequate oxygen flow) and fail to prevent an anaerobic condition in the vicinity of the tobacco leaves. Additionally, during such conventional curing processes, the tobacco leaves will emit carbon dioxide, which will further dilute the oxygen present in the curing environment. Under such anaerobic conditions, it is believed that the micro flora reduce nitrates to nitrites. Consequently, TSNA are formed and become part of the tobacco product that is ultimately consumed by the tobacco user.

The present invention is applicable to the treatment of harvested tobacco, which is intended for human consumption. Much research has been performed on tobacco, with particular reference to tobacco-specific nitrosamines (i.e., TSNAs). Freshly harvested tobacco leaves are called "green tobacco" and contain no known carcinogens, but green tobacco is not suitable for human consumption. The process of curing green tobacco depends on the type of tobacco harvested. For example, Virginia flue (bright) tobacco is typically flue-cured, whereas Burley and certain dark strains are usually air-cured. The flue-curing of tobacco typically takes place over a period of five to seven days compared to about one to two or more months for air-curing. According to Peele et al, flue-curing has generally been divided into three stages: yellowing (35–40° C.) for about 36–72 hours (although others report that yellowing begins sooner than 36 hours, e.g., at about 24 hours for certain Virginia flue strains), leaf drying (40–57° C.) for 48 hours, and midrib (stem) drying (57–75° C.) for 48 hours. Many major chemical and biochemical changes begin during the yellowing stage and continue through the early phases of leaf drying.

In a typical flue-curing process, the yellowing stage is carried out in a barn. During this phase the green leaves gradually lose color due to chlorophyll degradation, with the corresponding appearance of the yellow carotenoid pigments. According to the review by Peele et al, the yellowing stage of flue-curing tobacco is accomplished by closing external air vents in the barn, and holding the temperature at approximately 35°–37° C. The yellowing stage typically lasts about 3 to 5 days. After the yellowing stage, the air vents are opened, and the heat is gradually and incrementally raised. Over a period of about 5 to 7 days from the end of yellowing, the tobacco product is dried. Thus, this process utilizes a somewhat controlled environment, but the controlled environment is insufficient to ensure the prevention or reduction of nitrosamines as in the present invention. Specifically, the process during the yellowing maintains the relative humidity in the barn at approximately 85%, limits moisture loss from the leaves, and allows the leaf to continue the metabolic processes that has begun in the field. The goal of the flue-curing process is merely to obtain a dry product that has a lemon or golden orange color. In the flue-curing process, there is no appreciation for subjecting the tobacco leaves to a set of controlled conditions in order to ensure the prevention or reduction of TSNAs.

With one particular variety of Virginia flue tobacco on which testing has been carried out as described herein, freshly harvested green tobacco is placed in a barn for about 24–48 hours at about 100–110° F. until the leaves turn more or less completely yellow. The yellow tobacco has a reduced moisture content, i.e., from about 90 weight % when green, versus about 70–40 weight % when yellow. At this stage, the yellow tobacco contains essentially no known carcinogens, and the TSNA content is essentially the same as in the fresh-cut green tobacco. This Virginia flue tobacco typically remains in the yellow stage for about 6–7 days. At the end of curing, Virginia flue tobacco typically has a moisture content of about 11 to about 15 weight percent. The conversion of the tobacco during the curing process results in formation and substantial accumulation of nitrosamines, and an increased microbial content. The exact mechanism by which tobacco-specific nitrosamines are formed is not clear, but is believed to be enhanced by microbial activity, involving microbial nitrate reductases in the generation of nitrite during the curing process.

As previously mentioned, tobacco-specific nitrosamines are believed to be formed upon reaction of amines with nitrite-derived nitrosating species, such as $NO_2$, $N_2O_3$ and $N_2O_4$ under acidic or anaerobic conditions. Wiernik et al discuss the postulated formation of TSNAs at pp. 43–45, the discussion being incorporated herein by reference; a brief synopsis is set forth below.

Tobacco leaves contain an abundance of amines in the form of amino acids, proteins, and alkaloids. The tertiary amine nicotine (referenced as (1) in the diagram below) is the major alkaloid in tobacco, while other nicotine-type alkaloids are the secondary amines nornicotine (2), anatabine (3) and anabasine (4). Tobacco also generally contains up to 5% of nitrate and traces of nitrite.

Nitrosation of nornicotine (2), anatabine (3), and anabasine (4) gives the corresponding nitrosamines: N'-nitrosonornicotine (NNN, 5), N'-nitrosoanatabine (NAT, 6), and N'-nitrosoanatabine (NAB, 7). Nitrosation of nicotine (1) in aqueous solution affords a mixture of 4-(N-nitrosomethylamino)-1-(3-pyridyl)-1-butanone (NNK, 8) (NNN, 5) and 4-(N-nitrosomethylamino)-4-(3-pyridyl)-1-butanal (NNA, 9). Less commonly encountered TSNAs include NNAL (4-N-nitrosomethylamino)-1-(3-pyridyl)-1-butanol, 10), iso-NNAL (4-N-nitrosomethylamino)-4-3-pyridyl)-1-butanol, 11) and iso-NNAC (4-(N-nitrosomethylamino)-4-(3-pyridyl)-butanoic acid, 12). The formation of these TSNAs from the corresponding tobacco alkaloids is shown schematically below, using the designations 1–12 above (reproduced from Wiernik et al, supra, p. 44, and incorporated herein by reference):

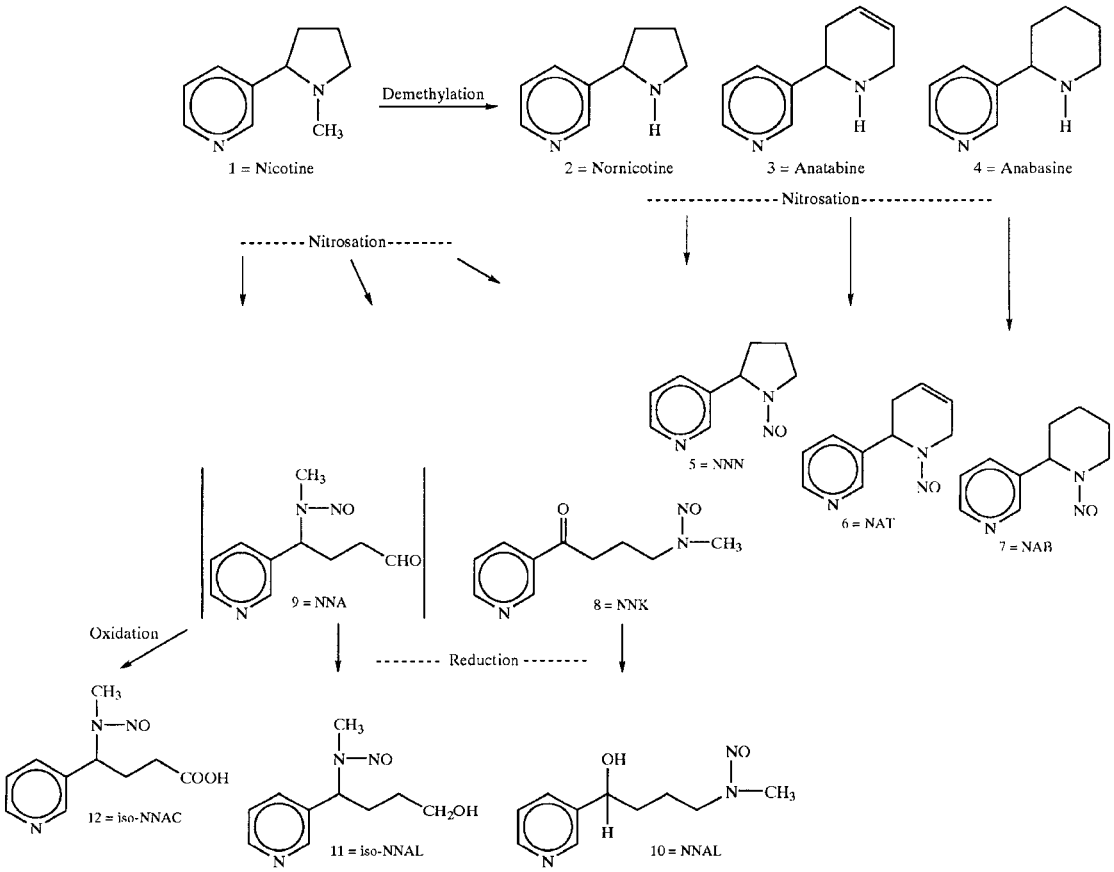

It is now generally agreed that green, freshly harvested tobacco contains virtually no nitrite or TSNA, and that these compounds are generated during curing and storage of tobacco. Studies have been made during the past decade to try to determine the events related to the formation of TSNA during curing of tobacco, and several factors of importance have been identified. These include plant genotype, plant maturity at harvest, curing conditions and microbial activity.

Studies have shown that nitrite and TSNA accumulate on air-curing at the time intervals starting after the end of yellowing and ending when the leaf turns completely brown, e.g., 2–3 weeks after harvest for certain air-cured strains, and approximately a week or so after harvest in flue-cured varieties. This is the time during which loss of cellular integrity occurs, due to moisture loss and leakage of the content of cells into the intercellular spaces. Therefore, there is a short window in time during air-curing when the cells have disintegrated, making the nutrition available for microorganisms. Wiernik et al have suggested that nitrite may then substantially accumulate as a result of dissimilatory nitrate reduction, thus rendering formation of TSNA possible.

There are a few published reports on the effects of microbial flora on the tobacco leaf during growth and curing and on cured tobacco, as cited in Wiernik et al. However, the involvement of microbial nitrite reductases in the generation of nitrate during curing is presumed. When cell structure is broken down after the yellow phase, and nutrients are made accessible to invading microorganisms, these may produce nitrite under favorable conditions, i.e., high humidity, optimal temperature and anoxia. There is normally a rather short "window" in time when the water activity is still sufficiently high, and the cell structure has disintegrated.

In accordance with one embodiment of the present invention, the formation of nitrosamines in a harvested tobacco plant is substantially prevented or arrested by a process, comprising subjecting at least a portion of the plant, while said portion is uncured and in a state susceptible to having the amount of nitrosamines reduced or formation of nitrosamines arrested, to a controlled environment capable of providing a reduction in the amount of nitrosamines or prevention of the formation of nitrosamines, for a time sufficient to reduce the amount of or substantially prevent the formation of at least one nitrosamine, wherein said controlled environment is provided by controlling at least one of humidity, rate of temperature change, temperature, airflow, CO level, $CO_2$ level, $O_2$ level, and arrangement of the tobacco leaves.

In accordance with preferred embodiments of the present invention, non-green and/or yellow tobacco products can be obtained which are suitable for human consumption, and which have a lower content of at least one tobacco-specific nitrosamine than conventionally cured tobacco. Green or fresh-cut tobacco is generally unsuitable for human consumption as noted above; "non-green" as used herein means the tobacco has at least lost the majority of chlorophyll, and includes without limitation partially yellow leaves, full yellow leaves, and leaves which have begun to turn brown in places.

The present invention is applicable to all strains of tobacco, including flue or bright varieties, Burley varieties, dark varieties, oriental/Turkish varieties, etc. Within the guidelines set forth herein, one of ordinary skill in the art could determine the most efficient time in the cure cycle for carrying out the treatment step to achieve the objects and advantages of the present invention.

Although the airflow through the barn may vary on a case-by-case basis and may be dependent on the arrangement of the tobacco leaves to be treated (i.e., the degree of tobacco leaf surface exposure) and the size of the curing apparatus or barn, the minimum flow of air is preferably about ten percent higher than the flow of flue gas commonly used in the prior art. As discussed above, however, it is within the scope of the present invention to provide relatively low airflow, provided that other parameters (e.g., humidity, temperature, etc.) are selected so that the prevention or reduction of at least one TSNA is achieved.

Preferably, the minimum flow of air may be about 70 CFM at 1" static pressure per cubic feet of curing apparatus or barn volume, more preferably 80 CFM at 1" static pressure per cubic feet of curing apparatus or barn volume. The specific minimum flow of air needed for a given set of conditions may be determined on a routine basis given the disclosure of the present invention.

To maximize the effects of the present invention, the humidity of the heated or unheated air is desirably controlled using a commercially-available dehumidifier or humidifier. Preferably, the heated or unheated air flow comprises dehumidified air with a humidity level of less than about 85%, more preferably less than about 60%, most preferably less than about 50%.

In one aspect, the air is fresh outside air, while the heated air is substantially free from combustion exhaust gases including water vapor, carbon monoxide, and carbon dioxide.

In addition, the air may be recirculated as long as an anaerobic condition is avoided.

The temperature within the curing barn of the present invention may range from ambient (i.e., outside) temperature to as high as about 250° F. or more, without charring the tobacco product. If heated air (i.e., convective heat) is used to accelerate the drying of the tobacco product, suitable temperatures may range anywhere from about 100° F. to about 250° F., more preferably from about 160° F. to about 170° F. However, the optimum temperature within the curing barn can be determined for each case, depending on the overall conditions of the environment and the tobacco product being treated.

The determination of the time for treating the tobacco according to the process of the present invention can be determined by trial and error. Typically, the treatment time may be from about 48 hours up to about 2 weeks.

The arrangement of the tobacco leaves is not critical, but it is advantageous to provide the highest exposed surface area for the tobacco leaves.

While it is not essential, it may be desirable to expose the tobacco product to UV light, either simultaneously with, or separately from, the treatment described above. It is believed that this UV light exposure can further reduce the amount of TSNA accumulation. For example, the UV light can be supplied using "Germicidal Sterilamp" tubes obtained from Philips Lighting, wherein the light has wavelengths of between 100 and 280 nm.

Although the curing process as described above is preferable over microwave curing techniques because microwaving requires moist tobacco whereas the inventive curing process does not, it is within the scope of the present invention to further treat the tobacco product with microwave or other high energy treatment, as described in copending U.S. applications Ser. Nos. 08/879,905 and 08/998,043, respectively now U.S. Pat. No. 6,135,121 and now abandoned, both of which are incorporated herein by reference. This additional microwave or other high energy treatment is conveniently performed within the window of time in which it is possible to further prevent or reduce the formation of at least one TSNA. While application Ser. Nos. 08/879,905, U.S. Pat. No. 6,135,121, and Ser. No. 08/998,043 now abandoned are incorporated herein by reference, the preferred aspects of the microwaving or other high energy treatment are described below.

The process of this invention may further comprise a microwaving process for reducing the amount of or preventing formation of nitrosamines in a harvested tobacco plant, which microwaving process comprises subjecting at least a portion of the plant to microwave radiation, while said portion is uncured and in a state susceptible to having the amount of nitrosamines reduced or formation of nitrosamines arrested, for a sufficient time to reduce the amount of or substantially prevent formation of at least one nitrosamine.

It is preferred that in this aspect of the process of the invention, the step of subjecting to microwave radiation is carried out on a tobacco leaf or portion thereof after onset of yellowing in the leaf and prior to substantial accumulation of tobacco-specific nitrosamines in the leaf It is also preferred that in this aspect of the process of the invention, the step of subjecting to microwave radiation is carried out prior to substantial loss of the leafs cellular integrity. Using microwave energy eliminates the potential for activation of the microbes that cause TSNAs in tobacco, particularly in tobacco that has been rehydrated.

The term "microwave radiation" as used herein refers to electromagnetic energy in the form of microwaves having a frequency and wavelength typically characterized as falling within the microwave domain. The term "microwave" generally refers to that portion of the electromagnetic spectrum which lies between the far-infrared region and the conventional radiofrequency spectrum. The range of microwaves extends from a wavelength of approximately 1 millimeter and frequency of about 300,000 MHz to wavelength of 30 centimeters and frequency of slightly less than about 1,000 MHz. The present invention preferably utilizes high power applications of microwaves, typically at the lower end of this frequency range. Within the preferred frequency range, there is a fundamental difference between a heating process by microwaves and by a classical way, such as by infrared (for example, in cooking): due to A greater penetration, microwaves generally heat quickly to a depth several centimeters while heating by infrared is much more superficial. In the United States, commercial microwave apparatuses, such as kitchen microwave ovens, are available at standard frequencies of approximately 915 MHz and 2450 MHz, respectively. These frequencies are standard industrial bands. In Europe, microwave frequencies of 2450 and 896 MHz are commonly employed. Under properly balanced conditions, however, microwaves of other frequencies and wavelengths would be useful to achieve the objects and advantages of the present invention.

Microwave energy can be generated at a variety of power levels, depending on the desired application. Microwaves are typically produced by magnatrons, at power levels of 600–1000 watts for conventional kitchen-level microwave apparatuses (commonly at about 800 watts), but commercial units are capable of generating power up to several hundred kilowatts, generally by addition of modular sources of a bout 1 kilowatt. A magnatron can generate either pulsed or continuous waves of suitably high frequency.

The applicator (or oven) is a necessary link between the microwave power generator and the material to be heated. For purposes of the present invention, any desired applicator can be used, so long as it is adapted to permit the tobacco plant parts to be effectively subjected to the radiation. The applicator should be matched to the microwave generator to optimize power transmission, and should avoid leakage of energy towards the outside. Multimode cavities (microwave ovens), the dimensions of which can be larger than several wavelengths if necessary for large samples, are useful. To ensure uniform heating in the leaves, the applicator can be equipped with a mode stirrer (a metallic moving device which modifies the field distribution continuously), and with a moving table surface, such as a conveyor belt. The best results are attained by single leaf thickness exposure to microwave radiation, as opposed to stacks or piles of leaves.

In preferred embodiments of the invention, the microwave conditions comprise microwave frequencies of about 900 MHz to about 2500 MHz, more preferably about 915 MHz and about 2450 MHz, power levels of from about 600 watts up to 300 kilowatts, more preferably from about 600 to about 1000 watts for kitchen-type applicators and from about 2 to about 75 kilowatts, more preferably from about 5 to about 50 kilowatts, for commercial multimode applicators. The heating time generally ranges from at least about 1 second, and more generally from about 10 seconds up to about 5 minutes. At power levels of about 800–1000 watts the heating time is preferably from about 1 minute to about 2½ minutes when treating single leaves as opposed to piles or stacks. For commercial-scale applicators using higher power levels in the range of, e.g., 2–75 kilowatts, heating times would be lower, ranging from about 5 seconds up to about 60 seconds, and generally in the 10–30 second range at, say, 50 kilowatts, again for single leaves as opposed to piles or stacks. Of course, one of ordinary skill in the art would understand that an optimal microwave field density could be determined for any given applicator based on the volume of the cavity, the power level employed, and the amount of moisture in the leaves. Generally speaking, use of higher power levels will require less time during which the leaf is subjected to the microwave radiation.

However, the above-described conditions are not absolute, and given the teachings of the present invention, one of ordinary skill in the art would be able to determine appropriate microwave parameters. The microwave radiation is preferably applied to the leaf or portion thereof for a time sufficient to effectively dry the leaf, without charring, so that it is suitable for human consumption. It is also preferred to apply the microwave radiation to the leaf or portion thereof for a time and at a power level sufficient to reduce the moisture content to below about 20% by weight, more preferably about 10% by weight.

It is also preferred in accordance with the present invention that the microwave radiation is applied to the leaf or portion thereof for a time sufficient to effectively dry the leaf, without charring, so that it is suitable for human consumption.

It is also possible to use forms of electromagnetic radiation having higher frequencies and shorter wavelengths than the microwave domain discussed above and in more detail below, can be used to achieve the basic objects of the present invention—reduction or substantial elimination of TSNAs in tobacco products, by treating the tobacco with such energy forms in the same time frame post-harvest as discussed above with regard to the microwave embodiment. Thus, the present invention further comprises a method for reducing the amount of or preventing formation of nitrosamines in a harvested tobacco plant, comprising subjecting at least a portion of the plant to radiation having a frequency higher than the microwave domain, while said portion is uncured and in a state susceptible to having the amount of nitrosamines reduced or formation of nitrosamines arrested, for a sufficient time to reduce the amount of or substantially prevent formation of at least one nitrosamine.

As with the microwave embodiments, it is preferred that in the process of the invention, the step of subjecting to radiation having a frequency higher than the microwave domain is carried out on a tobacco leaf or portion thereof after onset of yellowing in the leaf and prior to substantial accumulation of tobacco-specific nitrosamines in the leaf. It is also preferred that in the process of the invention, the step of subjecting to such radiation is carried out prior to substantial loss of the leafs cellular integrity. Preferred energy sources capable of producing such radiation are described further below, and include far-infrared and infrared radiation, UV (ultraviolet radiation), soft x-rays or lasers, accelerated particle beams such as electron beams, x-rays and gamma radiation.

On a scale within the electromagnetic spectrum where microwaves are generally defined as inclusive of those forms of electromagnetic radiation having a frequency of $10^{11}$ Hz and a wavelength of $3\times10^{-3}$ meters, such energy sources include, without limitation, far-infrared and infrared radiation having frequencies of about $10^{12}$ to $10^{14}$ Hz and wavelengths of $3\times10^{-4}$ to $3\times10^{-6}$ meters, ultraviolet radiation having frequencies of about $10^{16}$ to $10^{18}$ Hz and wavelengths of $3\times10^{-8}$ to $3\times10^{-10}$ meters, soft x-rays or lasers, cathode rays (a stream of negatively charged electrons issuing from the cathode of a vacuum tube perpendicular to the surface), x-rays and gamma radiation typically characterized as having frequencies of $10^{21}$ Hz and higher at corresponding wavelengths.

As would be apparent to one of ordinary skill in the art, the greater the dose of radiation delivered by the energy source, the less time the leaves need to be subjected thereto to achieve the desired results. Typically, radiation application times of less than one minute, preferably less than 30 seconds and even more preferably less than about ten seconds are needed when using such higher frequency radiation sources. Defined another way, radiation application times of at least about one second are preferred. However, the exposure rate can be controlled to deliver the radiation dosage over time, if desired. For example, 1 megarad of radiation can be delivered instantaneously, or at a predetermined exposure rate. When using high frequency radiation sources, it is preferred to use an amount of radiation which achieves at least a 50% reduction in TSNAs, in comparison to untreated samples. While the particular radiation dosages and exposure rate will depend on the particular equipment and type of radiation source being applied, as would be apparent to one of ordinary skill in the art, it is generally preferred to subject the tobacco samples to radiation of from about 0.1 to about 10 megarads, more preferably from about 0.5 to about 5 megarads, and more preferably from about 0.75 to about 1.5 megarads.

It is preferred that the microwaving or other high energy treatment, as described above, is conducted after subjecting the tobacco to the controlled environment of the present invention. However, it is also possible to conduct the optional microwaving or high energy treatment prior to subjecting the tobacco to the controlled environment of the present invention.

The treatment according to the present invention, with or without microwaving or other high energy treatment, may be performed in conventional barns as well as large-scale processing centers capable of treating tens of acres of tobacco. It is also possible to perform the process of the present invention in any size, including miniature curing apparatuses or barns.

On a bench scale, the treatment of the tobacco product according to the present invention, using airflow and temperature control, would be similar to treating tobacco product using a convective heating air oven or treating the tobacco product using a clothes dryer. Thus, it is within the present invention to operate the process of the present invention in a convective heating air oven or a clothes dryer, although these apparatuses are not within the scope of the curing apparatus or barns as defined in the appended claims.

In another embodiment, the present invention relates to a tobacco product comprising cured non-green or yellow tobacco suitable for human consumption and having a content of at least one tobacco-specific nitrosamine selected from N'-nitrosonornicotine (NNN), 4-(N-nitrosomethylamino)-1-(3-pyridyl)-1-butanone (NNK), N'-nitrosoanatabine (NAT) and N'-nitrosoanatabine (NAB) which is less than about 50% by weight of the content of said at least one tobacco-specific nitrosamine in conventionally cured tobacco, more preferably less than about 75% by weight, most preferably less than about 95% by weight, without the use of organic solvent extraction.

Thus, it is possible to reduce the TSNA content by about 97% or more by practicing the present invention, even down to "food safe" TSNA levels.

For example, the NNN level of the tobacco product according to the present invention is typically less than about 0.05 μg/g, the combined NAT and NAB level is typically less than about 0.10 μg/g, and the NNK level is typically less than about 0.05 μg/g. Further, the combined TSNA level is typically less than about 0.16 μg/g, even as low as less than about 0.009 μg/g.

Thus, in yet another aspect of the present invention, the tobacco product according to the present invention comprises cured non-green or yellow tobacco having a NNN content less than about 0.05 μg/g.

In a further aspect, the tobacco product of the present invention comprises cured non-green or yellow tobacco having a combined NAT and NAB content of less than about 0.10 μg/g.

Still further, the tobacco product of the present invention comprises cured non-green or yellow tobacco having a NNK content of less than about 0.05 μg/g.

Additionally, the present invention also contemplates tobacco product comprising cured non-green or yellow tobacco having a total TSNA content of less than about 0.16 μg/g.

In a preferred embodiment, the tobacco product of the present invention has a NNN level of less than about 0.05 μg/g, a combined NAT and NAB level of less than about 0.10 μg/g, and a NNK level less than about 0.05 μg/g.

The tobacco product according to the present invention can be converted to various final tobacco products, including, but not limited to, cigarettes, cigars, chewing tobacco, snuff and tobacco-containing gum and lozenges.

In yet another embodiment, the present invention is directed to an apparatus for curing tobacco products comprising:

an enclosed or substantially enclosed container comprising a base frame, optionally at least one wall, optionally a roof, and optionally a door;

an air handling device capable of providing an air flow of at least about 70 CFM at 1" static pressure per cubic feet of apparatus volume, wherein said air flow is at least partially and at least temporarily in communication with the interior of said container; and a heat exchanger capable of providing at least about 1,100 BTU/hour per cubic feet of apparatus volume.

If desired, the container may be in the form of a mobile unit with transport means. The container may be constructed to any suitable size typical of tobacco curing barns. For example, the container may have a width of about 120 inches, a depth of 60 inches, and a height of 82 inches. It is possible to provide a container that is significantly smaller or larger than this exemplified container size. In addition, the container may be insulated.

The container may comprise means that are capable of receiving the tobacco products to be cured. Preferably, these means are arranged so that the tobacco product is exposed for optimal curing.

Preferably, the air circulation within the container may be of a vertical or horizontal draft design, with the flow of air being in any suitable direction, with manually or automatically controlled fresh air dampers and weighted exhaust dampers. The blower for the air handling device can have a blower rating of, e.g., about 100 CFM at 0.4 inch WC static pressure per cubic feet of apparatus volume.

The heat exchanger is preferably constructed of stainless steel. The heat exchanger system is preferably supplied with a flame detector, ignitor wire, sensor cable, dual valve gas train and/or air proving switch. The burner setting can be variable. As mentioned previously, however, it is possible to carry out the process of the present invention without the use of any heat. That is, the process can be conducted using simply a sufficient flow of air.

In the present invention, the apparatus for curing the tobacco products uses air that is free from combustion exhaust gases, such as carbon monoxide and carbon dioxide. However, it should be noted that with sufficient airflow, the effects of the present invention can be realized even with air containing combustion exhaust gases.

Figure 2:
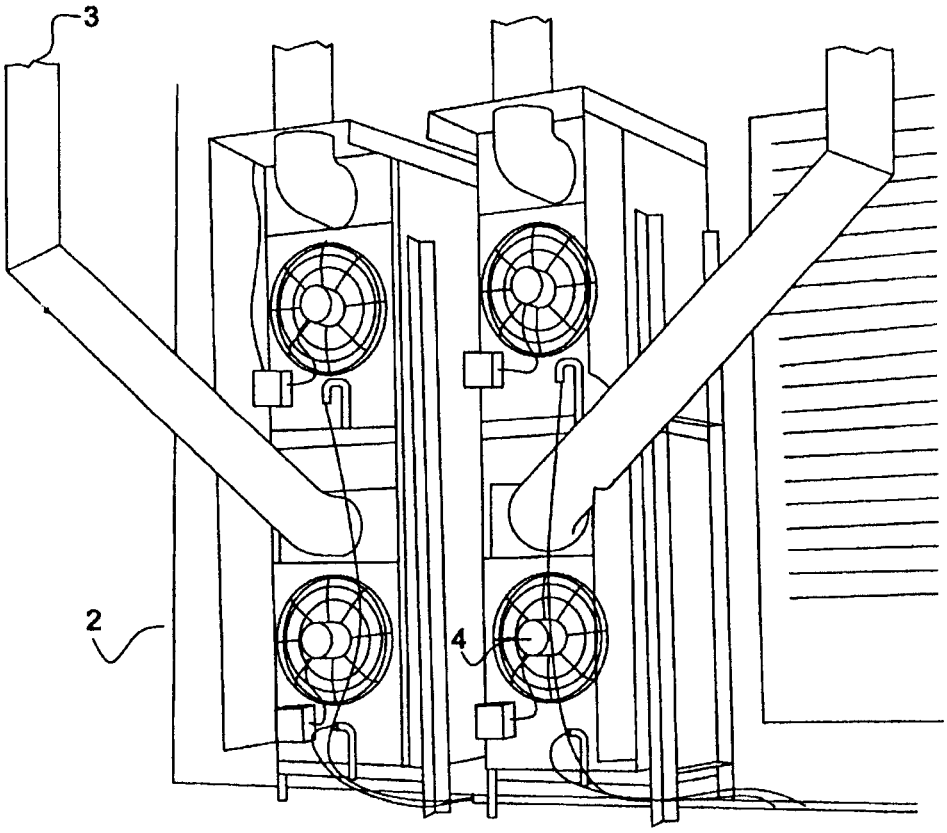
FIG. 2 illustrates the air-handling device/heat exchanger system of the tobacco-curing apparatus according to the present invention.

Reference is now made to the drawings. FIG. 1 shows a container (1) and an air handling device/heat exchanger system (2). FIG. 2 shows the air handling device/heat exchange system (2) in greater detail. It can be seen from FIG. 2 that the exhausts (3) of the heat exchanger system is far removed from the air intakes (4) to minimize the possibility of combustion exhaust gases being introduced into the curing apparatus. Further, unlike conventional curing barns, the curing apparatus of the present invention features an externalized air handling device/heat exchanger system.

The following examples illustrate the advantages of the present invention.

EXAMPLES

In each of the examples described below, five grams of ground tobacco were placed in a 300-ml Erlenmayer flask and suspended in 150-ml water to which 5 ml of 20% ammonium sulfamate in 3.6 N $H_2SO_4$ was added to prevent the artificial formation of TSNA during extraction. Prior to shaking on the wrist-action shaker overnight, the flask was capped using parafilm and wrapped up in aluminum foil to prevent degradation of TSNA by light. The TSNA were extracted.

The final TSNA extract (pH 9 fraction) was transferred quantitative using a Pasteur pipette into a 1 ml volumetric flask and adjusted for full volume. Samples were stored in GC vials until GC-TEA analysis.

For the TSNA analysis, an aliquot of 0.1 ml was dried in a GC vial with a gentle stream of nitrogen and the GC standard (N-nitrosoguvacoline; 3.2 ppm) in acetonitrile was added prior to analysis. The GC-TEA was calibrated with a standard TSNA mixture on a daily basis, before and after analyses of tobacco extracts.

GC Hewlett Packard Model 5890 and TEA™ Model 543 Analyzer were used.

Example 1

This experiment shows the advantages of the present invention on a reduced scale.

Yellow tobacco leaf was finely diced with scissors and subjected to curing for 45 minutes at 167° F. using convective heat in the form of a hot air stream substantially free from combustion exhaust gases. (A hot convection air oven was used for this purpose.) The sample was rather moist, and therefore, a wet weight was taken and calculations were made to correct the TSNA content to dry weight basis. 75% of the leaf was moisture, and thus the wet weight was multiplied by 0.25 to obtain the dry weight. The results are tabulated in Table 1 below.

Although the treatment was made only for 45 minutes, longer or shorter treatment times are envisioned depending on the conditions and the results desired.

Comparative Example 1

Instead of the convective heat treatment described in Example 1 above, yellow tobacco leaf was microwaved. The results are set forth in Table 1 below.

Example 2

Instead of the convective heat treatment described in Example 1 above, yellow tobacco leaf (Virginia) was subjected to a modified flue-curing technique that eliminates the flow of combustion exhaust gases into the curing barn. This was accomplished by using a heat exchanger. The treated tobacco was tested, and the results are given in Table 1.

TABLE 1

| EXAMPLE NO. | μg/g NNN | μg/g NAT + NAB | μg/g NNK | μg/g TSNA |
|---|---|---|---|---|
| Ex. 1 | 0.0310 | 0.0843 | <0.0004 | 0.1157 |
| Comp. Ex. 1 | <0.0004 | <0.0006 | <0.0005 | <0.0014 |
| Ex. 2 | 0.0451 | 0.1253 | 0.0356 | 0.2061 |

As can be seen from Table 1, the process of the present invention provides tobacco having substantially reduced amounts of TSNA.

Example 3

Yellow tobacco leaf was treated with a flow of air using a MAYTAG clothes dryer under "fluff dry" at 85° F. in Example 3. The results are shown in Table 2.

Example 4

This experiment shows the efficacy of the present invention featuring drying without the use of heat. In this example, yellow tobacco leaf was treated with a flow of unheated air using a MAYTAG clothes dryer for six hours. The results are shown in Table 2.

Comparative Example 2

Tobacco leaf was flue cured according to a predominant version of the conventional flue curing process in a curing barn. As is the common practice for such conventional flue-curing, the combustion exhaust gases were vented through the curing barn in this process. In this conventional flue curing process, tobacco was placed in a barn with relatively low flow of air and closed external air vents. The temperature was incrementally increased (about 0.5 to 1.5° F. per hour) to about 130° F. over a period of about 3 days. At this point (i.e., end of yellowing), the external air vents were opened, and the temperature was maintained at 130° F. for about 24–36 hours. The external air vents were then closed and the temperature was raised to about 160° F. to initiate the "killing out phase" (i.e., the phase in which the stem is dried) with relatively low air flow. It is important to note that in the conventional flue curing process, the air flow (any fresh air plus any recirculating air) is significantly lower than what is typically used in the present invention. The results are shown in Table 2.

Comparative Example 3

Yellow tobacco leaf was microwaved for 60 seconds in a commercial tobacco microwaving plant. The results are shown in Table 2.

Comparative Example 4

Yellow tobacco leaf was again microwaved for 60 seconds in a commercial tobacco microwaving plant. The results are shown in Table 2

TABLE 2

| EXAMPLE NO. | μg/g NNN | μg/g NAT + NAB | μg/g NNK | μg/g TSNA |
|---|---|---|---|---|
| Ex. 3 | 0.037 | 0.046 | <0.001 | 0.084 |
| Ex. 4 | 0.042 | 0.054 | <0.001 | 0.097 |
| Comp. Ex. 2 | 0.77 | 0.89 | 1.37 | 3.03 |
| Comp. Ex. 3 | 0.04 | 0.054 | <0.001 | 0.095 |
| Comp. Ex. 4 | <0.001 | 0.042 | <0.001 | 0.044 |

Examples 3 and 4 provided very low levels of TSNA, especially NNN and NNK, even when microwaving was not used.

Example 5

Yellow tobacco leaf in the outer portion of a curing barn was subjected to a flow of air for 7 days according to the present invention. The results are tabulated in Table 3.

Example 6

Yellow tobacco leaf in the inner portion of a curing bar was subjected to a flow of air for 7 days according to the present invention. The results are tabulated in Table 3.

Comparative Example 5

Yellow tobacco leaf cured in a curing barn according to a conventional curing process was tested for TSNA levels. The results are shown in Table 3.

TABLE 3

| EXAMPLE NO. | μg/g NNN | μg/g NAT + NAB | μg/g NNK | μg/g TSNA |
|---|---|---|---|---|
| Ex. 5 | 0.03 ± .02 | 0.06 | 0.05 | 0.14 ± .02 |
| Ex. 6 | 0.04 ± .01 | 0.08 ± .02 | 0.04 | 0.15 ± .01 |
| Comp. Ex. 5 | 0.41 ± .04 | 1.16 ± .13 | 1.56 ± .21 | 3.14 ± .36 |

As is apparent from Table 3, the curing process according to the present invention provided unexpectedly lower levels of TSNA as compared to a conventional curing process.

Example 7

This example illustrates the advantageous effects obtainable by practicing the present invention even under the most severe environmental conditions. Throughout all phases of the curing, combustion exhaust gases were not allowed to flow into the barn.

Green tobacco was left in a curing barn according to the present invention for about 72 hours with the external air vent closed, but with recirculating air of about 25,000 CFM, and with heating of about 300,000 BTUs to provide a temperature of about 105° F. After this period of about 72 hours (end of yellowing), the external air vents were opened and the air handling device was adjusted to provide virtually all fresh air flow of approximately 25,000 CFM (with only a minor amount of recirculating air), and the heat was increased to about 1,000,000 BTUs to provide a rapid temperature increase to about 140° F. This treatment was continued for about 72 hours. At this point, the "killing out" phase (i.e., drying of the stems) was initiated by closing the external air vents and increasing the temperature to about 160° F. Treatment continued for about 1–2 days.

The resulting tobacco product was tested for TSNAs according to the analytical technique described above. The levels for each individual nitrosamine were so low that they could not be detected.

What is claimed is:

1. A process of substantially preventing the formation of at least one nitrosamine in a Virginia flue tobacco plant by treating the tobacco plant after the yellowing stage, the process comprising:

heating at least a portion of a Virginia flue tobacco plant with a flow of air while said portion is uncured, yellow, and in a state susceptible to having formation of said at least one nitrosamine arrested, for a time sufficient to substantially prevent formation of said at least one nitrosamine;

wherein said flow of air is sufficient to avoid an anaerobic condition around the vicinity of said plant portion.

2. The process of claim 1, wherein the air is heated to a temperature of from about 100° F. to about 250° F.

3. The process of claim 2, wherein the temperature is from about 160° F. to about 170° F.

4. The process of claim 1, further comprising converting said plant portion into a tobacco product selected from the group consisting of cigarettes, cigars, chewing tobacco, snuff, gum, and lozenges.

5. A process of substantially preventing the formation of at least one nitrosamine in a Virginia flue tobacco plant by treating the tobacco plant after the yellowing stage, the process comprising:

drying at least a portion of a Virginia flue tobacco plant, while said portion is uncured, yellow, and in a state susceptible to having the formation of nitrosamines arrested, in a controlled environment and for a time sufficient to substantially prevent the formation of said at least one nitrosamine;

wherein said controlled environment comprises a flow of air sufficient to avoid an anaerobic condition around the vicinity of said plant portion;

wherein said controlled environment is provided by controlling at least one of humidity, temperature, and airflow.

6. The process of claim 5, wherein the airflow is at least about 70 CFM at 1" static pressure per cubic foot of volume.

7. The process of claim 6, wherein the airflow is at least about 80 CFM at 1" static pressure per cubic foot of volume.

8. The process of claim 5, wherein the air is heated to a temperature of from about 100° F. to about 250° F.

9. The process of claim 8, wherein the temperature is from about 160° F. to about 170° F.

10. The process of claim 5, further comprising converting said dried plant portion into a tobacco product selected from the group consisting of cigarettes, cigars, chewing tobacco, snuff, gum, and lozenges.

11. A process of substantially preventing the formation of N'-nitrosonornicotine in a harvested tobacco plant by treating the tobacco plant after the yellowing stage, the process comprising:

heating at least a portion of a tobacco plant with a flow of air while said portion is uncured, yellow, and in a state susceptible to having formation of N'-nitrosonornicotine arrested, for a time sufficient to substantially prevent formation of N'-nitrosonornicotine;

wherein said flow of air is sufficient to avoid an anaerobic condition around the vicinity of said plant portion.

12. The process of claim 11, wherein the air is heated to a temperature of from about 100° F. to about 250° F.

13. The process of claim 12, wherein the temperature is from about 160° F. to about 170° F.

14. The process of claim 11, further comprising converting said plant portion into a tobacco product selected from the group consisting of cigarettes, cigars, chewing tobacco, snuff, gum, and lozenges.

15. A process of substantially preventing the formation of N'-nitrosonornicotine in a harvested tobacco plant by treating the tobacco plant after the yellowing stage, the process comprising:

drying at least a portion of a tobacco plant, while said portion is uncured, yellow, and in a state susceptible to having the formation of N'-nitrosonornicotine arrested, in a controlled environment and for a time sufficient to substantially prevent the formation of N'-nitrosonornicotine;

wherein said controlled environment comprises a flow of air sufficient to avoid an anaerobic condition around the vicinity of said plant portion;

wherein said controlled environment is provided by controlling at least one of humidity, temperature, and airflow.

16. The process of claim 15, wherein the airflow is at least about 70 CFM at 1" static pressure per cubic foot of volume.

17. The process of claim 16, wherein the airflow is at least about 80 CFM at 1" static pressure per cubic foot of volume.

18. The process of claim 15, wherein the air is heated to a temperature of from about 100° F. to about 250° F.

19. The process of claim 18, wherein the temperature is from about 160° F. to about 170° F.

20. The process of claim 15, further comprising converting said dried plant portion into a tobacco product selected from the group consisting of cigarettes, cigars, chewing tobacco, snuff, gum, and lozenges.

21. A process of substantially preventing the formation of 4-(N-nitrosomethylamino)-1-(3-pyridyl)-1-butanone in a harvested tobacco plant by treating the tobacco plant after the yellowing stage, the process comprising:

heating at least a portion of a tobacco plant with a flow of air while said portion is uncured, yellow, and in a state susceptible to having formation of 4-(N-nitrosomethylamino)-1 -(3-pyridyl)-1-butanone arrested, for a time sufficient to substantially prevent formation of 4-(N-nitrosomethylamino)-1-(3-pyridyl)-1-butanone;

wherein said flow of air is sufficient to avoid an anaerobic condition around the vicinity of said plant portion.

22. The process of claim 21, wherein the air is heated to a temperature of from about 100° F. to about 250° F.

23. The process of claim 22, wherein the temperature is from about 160° F. to about 170° F.

24. The process of claim 21, further comprising converting said plant portion into a tobacco product selected from the group consisting of cigarettes, cigars, chewing tobacco, snuff gum, and lozenges.

25. A process of substantially preventing the formation of 4-(N-nitrosomethylamino)-1-(3-pyridyl)-1-butanone in a harvested tobacco plant by treating the tobacco plant after the yellowing stage, the process comprising:

drying at least a portion of a tobacco plant while said portion is uncured, yellow, and in a state susceptible to having the formation of 4-(N-nitrosomethylamino)-1-(3-pyridyl)-1-butanone arrested, in a controlled environment and for a time sufficient to substantially prevent the formation of 4-(N-nitrosomethylamino)-1-(3-pyridyl)-1-butanone;

wherein said controlled environment comprises a flow of air sufficient to avoid an anaerobic condition around the vicinity of said plant portion;

wherein said controlled environment is provided by controlling at least one of humidity, temperature, and airflow.

26. The process of claim 25, wherein the airflow is at least about 70 CFM at 1" static pressure per cubic foot of volume.

27. The process of claim 26, wherein the airflow is at least about 80 CFM at 1" static pressure per cubic foot of volume.

28. The process of claim 25, wherein the air is heated to a temperature of from about 100° F. to about 250° F.

29. The process of claim 28, wherein the temperature is from about 160° F. to about 170° F.

30. The process of claim 25, further comprising converting said dried plant portion into a tobacco product selected from the group consisting of cigarettes, cigars, chewing tobacco, snuff, gum, and lozenges.

31. A process of substantially preventing the formation of N'-nitrosonornicotine, 4-(N-nitrosomethylamino)-1-(3-pyridyl)-1-butanone, N'-nitrosoanatabine, and N'-nitrosoanabasine in a harvested tobacco plant by treating the tobacco plant after the yellowing stage, the process comprising:

heating at least a portion of a tobacco plant with a flow of air while said portion is uncured, yellow, and in a state susceptible to having formation of N'-nitrosonornicotine, 4-(N-nitrosomethylamino)-1-(3-pyridyl)-1-butanone, N'-nitrosoanatabine, and N'-nitrosoanabasine arrested, for a time sufficient to substantially prevent formation of N'-nitrosonornicotine, 4-(N-nitrosomethylamino)-1-(3-pyridyl)-1-butanone, N'-nitrosoanatabine, and N'-nitrosoanabasine;

wherein said flow of air is sufficient to avoid an anaerobic condition around the vicinity of said plant portion.

32. The process of claim 31, wherein the air is heated to a temperature of from about 100° F. to about 250° F.

33. The process of claim 32, wherein the temperature is from about 160° F. to about 170° F.

34. The process of claim 31, further comprising converting said plant portion into a tobacco product selected from the group consisting of cigarettes, cigars, chewing tobacco, snuff, gum, and lozenges.

35. A process of substantially preventing the formation of N'-nitrosonornicotine, 4-(N-nitrosomethylamino)-1-(3-pyridyl)-1-butanone, N'-nitrosoanatabine, and N'-nitrosoanabasine in a harvested tobacco plant by treating the tobacco plant after the yellowing stage, the process comprising:

drying at least a portion of a tobacco plant, while said portion is uncured, yellow, and in a state susceptible to having the formation of N'-nitrosonornicotine, 4-(N-nitrosomethylamino)-1-(3-pyridyl)-1-butanone, N'-nitrosoanatabine, and N'-nitrosoanabasine arrested, in a controlled environment and for a time sufficient to substantially prevent the formation of N'-nitrosonornicotine, 4-(N-nitrosomethylamino)-1-(3-pyridyl)-1-butanone, N'-nitrosoanatabine, and N'-nitrosoanabasine;

wherein said controlled environment comprises a flow of air sufficient to avoid an anaerobic condition around the vicinity of said plant portion;

wherein said controlled environment is provided by controlling at least one of humidity, temperature, and airflow.

36. The process of claim 35, wherein the airflow is at least about 70 CFM at 1" static pressure per cubic foot of volume.

37. The process of claim 36, wherein the airflow is at least about 80 CFM at 1" static pressure per cubic foot of volume.

38. The process of claim 35, wherein the air is heated to a temperature of from about 100° F. to about 250° F.

39. The process of claim 38, wherein the temperature is from about 160° F. to about 170° F.

40. The process of claim 35, further comprising converting said dried plant portion into a tobacco product selected from the group consisting of cigarettes, cigars, chewing tobacco, snuff, gum, and lozenges.

41. A process of substantially preventing the formation of at least one nitrosamine in a Virginia flue tobacco plant by treating the tobacco plant after the yellowing stage, the process comprising:

drying at least a portion of a Virginia flue tobacco plant, while said portion is uncured, yellow, and in a state susceptible to having the formation of nitrosamines arrested, in a controlled environment and for a time sufficient to substantially prevent the formation of said at least one nitrosamine;

wherein said controlled environment comprises air free of combustion exhaust gases and an airflow sufficient to substantially prevent an anaerobic condition around the vicinity of said plant portion;

wherein said controlled environment is provided by controlling at least one of humidity, temperature, and airflow.

42. The process of claim 41, wherein the airflow is at least about 70 CFM at 1" static pressure per cubic foot of volume.

43. The process of claim 42, wherein the airflow is at least about 80 CFM at 1" static pressure per cubic foot of volume.

44. The process of claim 41, wherein the air is heated to a temperature of from about 100° F. to about 250° F.

45. The process of claim 44, wherein the temperature is from about 160° F. to about. 170° F.

46. The process of claim 41, further comprising converting said dried plant portion into a tobacco product selected from the group consisting of cigarettes, cigars, chewing tobacco, snuff, gum, and lozenges.

47. A process of substantially preventing the formation of N'-nitrosonornicotine in a harvested tobacco plant by treating the tobacco plant after the yellowing stage, the process comprising:

drying at least a portion of a tobacco plant, while said portion is uncured, yellow, and in a state susceptible to having the formation of N'-nitrosonornicotine arrested, in a controlled environment and for a time sufficient to substantially prevent the formation of N'-nitrosonornicotine;

wherein said controlled environment comprises air free of combustion exhaust gases and an airflow sufficient to substantially prevent an anaerobic condition around the vicinity of said plant portion;

wherein said controlled environment is provided by controlling at least one of humidity, temperature, and airflow.

48. The process of claim 47, wherein the airflow is at least about 70 CFM at 1" static pressure per cubic foot of volume.

49. The process of claim 48, wherein the airflow is at least about 80 CFM at 1" static pressure per cubic foot of volume.

50. The process of claim 47, wherein the air is heated to a temperature of from about 100° F. to about 250° F.

51. The process of claim 50, wherein the temperature is from about 160° F. to about 170° F.

52. The process of claim 47, further comprising converting said dried plant portion into a tobacco product selected from the group consisting of cigarettes, cigars, chewing tobacco, snuff, gum, and lozenges.

53. A process of substantially preventing the formation of 4-(N-nitrosomethylamino)-1-(3-pyridyl)-1-butanone in a harvested tobacco plant by treating the tobacco plant after the yellowing stage, the process comprising:

drying at least a portion of a tobacco plant, while said portion is uncured, yellow, and in a state susceptible to having the formation of 4-nitrosomethylamino)-1-(3-pyridyl)-1-butanone arrested, in a controlled environment and for a time sufficient to substantially prevent the formation of 4-(N-nitrosomethylamino)-1-(3-pyridyl)-1-butanone;

wherein said controlled environment comprises a flow of air sufficient to avoid an anaerobic condition around the vicinity of said plant portion;

wherein said controlled environment is provided by controlling at least one of humidity, temperature, and airflow.

54. The process of claim 53, wherein the airflow is at least about 70 CFM at 1" static pressure per cubic foot of volume.

55. The process of claim 54, wherein the airflow is at least about 80 CFM at 1" static pressure per cubic foot of volume.

56. The process of claim 53, wherein the air is heated to a temperature of from about 100° F. to about 250° F.

57. The process of claim 56, wherein the temperature is from about 160° F. to about 170° F.

58. The process of claim 53, further comprising converting said dried plant portion into a tobacco product selected from the group consisting of cigarettes, cigars, chewing tobacco, snuff, gum, and lozenges.

59. A process of substantially preventing the formation of N'-nitrosonornicotine, 4-(N-nitrosomethylamino)-1-(3-pyridyl)-1-butanone, N'-nitrosoanatabine, and N'-nitrosoanabasine in a harvested tobacco plant by treating the tobacco plant after the yellowing stage, the process comprising:

drying at least a portion of a tobacco plant, while said portion is uncured, yellow, and in a state susceptible to having the formation of N'-nitrosonornicotine, 4-(N-nitrosomethylamino)-1-(3-pyridyl)-1-butanone, N'-nitrosoanatabine, and N'-nitrosoanabasine arrested, in a controlled environment and for a time sufficient to substantially prevent the formation of N'-nitrosonornicotine, 4-(N-nitrosomethylamino)-1-(3-pyridyl)-1-butanone, N'-nitrosoanatabine, and N'-nitrosoanabasine;

wherein said controlled environment comprises air free of combustion exhaust gases and an airflow sufficient to substantially prevent an anaerobic condition around the vicinity of said plant portion;

wherein said controlled environment is provided by controlling at least one of humidity, temperature, and airflow.

60. The process of claim 59, wherein the airflow is at least about 70 CFM at 1" static pressure per cubic foot of volume.

61. The process of claim 60, wherein the airflow is at least about 80 CFM at 1" static pressure per cubic foot of volume.

62. The process of claim 59, wherein the air is heated to a temperature of from about 100° F. to about 250° F.

63. The process of claim 62, wherein the temperature is from about 160° F. to about 170° F.

64. The process of claim 59, further comprising converting said dried plant portion into a tobacco product selected from the group consisting of cigarettes, cigars, chewing tobacco, snuff, gum, and lozenges.

* * * * *

UNITED STATES PATENT AND TRADEMARK OFFICE

CERTIFICATE OF CORRECTION

PATENT NO. : 6,425,401 B1
DATED : July 30, 2002
INVENTOR(S) : Jonnie R. Williams It is certified that error appears in the above-identified patent and that said Letters Patent is hereby corrected as shown below:

Column 24,
Line 14, after "controlled environment comprises," insert the following -- air free of combustion exhaust gases and --.

Signed and Sealed this

Twenty-fourth Day of September, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,425,401 B1
DATED : July 30, 2002
INVENTOR(S) : Jonnie R. Williams It is certified that error appears in the above-identified patent and that said Letters Patent is hereby corrected as shown below:

Column 1,
Line 10, -- which -- has been inserted after "649,",
Line 39, "Wiemik et al" has been replaced with -- Wiernik et al --.

Column 2,
Lines 50 and 52, "Wiemik et al" has been replaced with -- Wiernik et al --.

Column 4,
Line 63, "N'–nitrosoanatabine" has been replaced with -- N'–nitrosoanabasine --.

Column 5,
Line 53, "N'–nitrosoanatabine" has been replaced with -- N'–nitrosoanabasine --.

Column 6,
Line 42, "variety" has been replaced with -- varietal --.

Column 7,
Line 38, "th e" has beed replaced with -- the --.

Column 9,
Line 59, "arc" has been replaced with -- are --,
Line 65, "N'–nitrosoanatabine" has been replaced with -- N'–nitrosoanabasine --.

Column 10,
Line 4, "4–3" has been replaced with -- 4–(3 --.

Column 13,
Line 5, "leaf" has been replaced with -- leaf. --,
Line 24, "the" has been replaced with -- this --,
Line 27, "A" has been replaced with -- a --,
Line 45, "a bout" has been replaced with -- about --.

Column 16,
Line 2, "N'–nitrosoanatabine" second occurrence has been replaced with -- N'–nitrosoanabasine --.

UNITED STATES PATENT AND TRADEMARK OFFICE

CERTIFICATE OF CORRECTION

PATENT NO. : 6,425,401 B1
DATED : July 30, 2002
INVENTOR(S) : Jonnie R. Williams It is certified that error appears in the above-identified patent and that said Letters Patent is hereby corrected as shown below:

Column 19,
Line 27, "bar" has been replaced with -- barn --.

Signed and Sealed this

First Day of April, 2003

JAMES E. ROGAN
*Director of the United States Patent and Trademark Office*

US006425401C1

(12) EX PARTE REEXAMINATION CERTIFICATE (8242nd)

United States Patent

Williams

(10) Number: US 6,425,401 C1

(45) Certificate Issued: *May 17, 2011

(54) METHOD OF TREATING TOBACCO TO REDUCE NITROSAMINE CONTENT, AND PRODUCTS PRODUCED THEREBY

(76) Inventor: Jonnie R. Williams, Manakin-Sabot, VA (US)

Reexamination Request:
No. 90/009,372, Jan. 2, 2009

Reexamination Certificate for:

| | |
|---|---|
| Patent No.: | **6,425,401** |
| Issued: | **Jul. 30, 2002** |
| Appl. No.: | **09/668,144** |
| Filed: | **Sep. 25, 2000** |

(*) Notice: This patent is subject to a terminal disclaimer.

Certificate of Correction issued Sep. 24, 2002.

Certificate of Correction issued Apr. 1, 2003.

Related U.S. Application Data

(63) Continuation of application No. 09/397,018, filed on Sep. 15, 1999, now Pat. No. 6,202,649, which is a continuation-in-part of application No. 08/998,043, filed on Dec. 23, 1997, now abandoned, which is a continuation-in-part of application No. 08/879,905, filed on Jun. 20, 1997, now Pat. No. 6,135,121, which is a continuation-in-part of application No. 08/757,104, filed on Dec. 2, 1996, now Pat. No. 5,803,081.

(60) Provisional application No. 60/100,372, filed on Sep. 15, 1998.

(51) Int. Cl.
*A24B 1/02* (2006.01)

(52) U.S. Cl. ..... 131/303; 131/290; 131/296; 131/300; 131/302; 131/303

(58) Field of Classification Search ..... None
See application file for complete search history.

(56) References Cited

U.S. PATENT DOCUMENTS

| | | | |
|---|---|---|---|
| 240,252 | A | 4/1881 | Huck |
| 514,370 | A | 2/1894 | Knott |
| 1,017,713 | A | 2/1912 | Vaughan |
| 1,194,351 | A | 8/1916 | Benjamin |
| 1,339,373 | A | 5/1920 | Buensod |
| 1,543,245 | A | 6/1925 | Buensod |
| 1,545,811 | A | 6/1925 | Buensod |
| 1,568,316 | A | 1/1926 | Buensod |
| 2,082,289 | A | 6/1937 | Hodgin |
| 2,124,012 | A | 7/1938 | Smith, Jr. |
| 2,134,843 | A | 11/1938 | Rouse |

(Continued)

FOREIGN PATENT DOCUMENTS

| | | |
|---|---|---|
| CA | 1026186 | 2/1978 |
| DE | 1767677 | 11/1971 |
| DE | P 3904169.7 | 8/1990 |

(Continued)

OTHER PUBLICATIONS

44th Tobacco Chemists' Research Conference, Winston Salem, NC, Program Booklet And Abstracts, vol. 44, pp. 32–33 (Sep. 30, 1990).

(Continued)

*Primary Examiner*—Brenda Brumback

(57) ABSTRACT

A method of treating tobacco to reduce the content of, or prevent formation of, harmful nitrosamines which are normally found in tobacco is disclosed. The method includes the step of subjecting at least a portion of the plant, while the portion is uncured and in a state susceptible to having the amount of nitrosamines reduced or formation of nitrosamines arrested, to a controlled environment capable of providing a reduction in the amount of nitrosamines or prevention of the formation of nitrosamines, for a time sufficient to reduce the amount of or substantially prevent the formation of at least one nitrosamine, wherein the controlled environment is provided by controlling at least one of humidity, rate of temperature change, temperature, airflow, CO level, $CO_2$ level, $O_2$ level, and arrangement of the tobacco plant. Tobacco products and an apparatus for producing such tobacco products are also disclosed.

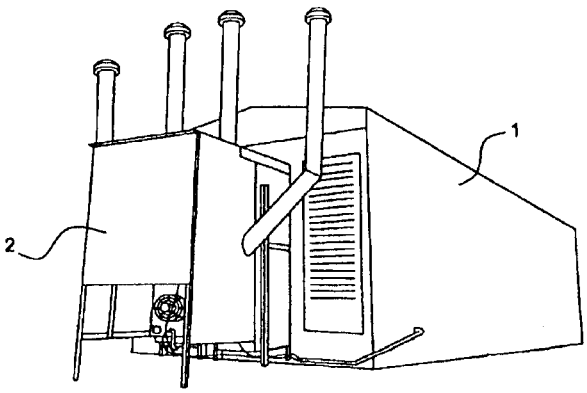

U.S. PATENT DOCUMENTS

| | | | |
|---|---|---|---|
| 2,343,345 | A | 3/1944 | Touton |
| 2,475,568 | A | 7/1949 | Moore, Jr. |
| 2,534,618 | A | 12/1950 | Moore, Jr. |
| 2,758,603 | A | 8/1956 | Heljo |
| 2,989,057 | A | 6/1961 | Touton |
| 3,024,792 | A | 3/1962 | Touton |
| 3,039,475 | A | 6/1962 | Neukomm et al. |
| 3,105,713 | A | 10/1963 | Hassler |
| 3,109,637 | A | 11/1963 | Taylor |
| 3,134,583 | A | 5/1964 | Wilson |
| 3,202,157 | A | 8/1965 | Touton |
| 3,233,339 | A | 2/1966 | Long et al. |
| 3,251,620 | A | 5/1966 | Hassler |
| 3,394,709 | A | 7/1968 | Remer |
| 3,494,723 | A | 2/1970 | Gray |
| 3,494,724 | A | 2/1970 | Gray |
| 3,503,137 | A | 3/1970 | Wilson |
| 3,664,034 | A | 5/1972 | Wilson |
| 3,669,429 | A | 6/1972 | Dew |
| 3,699,976 | A | 10/1972 | Abe et al. |
| 3,773,055 | A | 11/1973 | Stungis et al. |
| 3,785,384 | A | 1/1974 | Sylvester et al. |
| 3,845,774 | A | 11/1974 | Tso et al. |
| 3,870,053 | A | 3/1975 | Heitkamp et al. |
| 3,877,468 | A | 4/1975 | Lichtneckert et al. |
| 3,899,836 | A | 8/1975 | Johnson |
| 3,901,248 | A | 8/1975 | Lichtneckert et al. |
| 3,927,683 | A | 12/1975 | Wilson et al. |
| 3,932,946 | A | 1/1976 | Johnson |
| 3,937,227 | A | 2/1976 | Azumano |
| 4,036,454 | A | 7/1977 | Jordan et al. |
| 4,045,066 | A | 8/1977 | Griffin et al. |
| 4,099,338 | A | 7/1978 | Mullin et al. |
| 4,114,288 | A | 9/1978 | Fowler |
| 4,123,221 | A | 10/1978 | Danford |
| 4,156,431 | A | 5/1979 | Epstein et al. |
| 4,178,946 | A | 12/1979 | Knight |
| 4,192,323 | A | 3/1980 | Horne |
| 4,206,554 | A | 6/1980 | Fowler |
| 4,212,634 | A | 7/1980 | Mitchell et al. |
| 4,247,992 | A | 2/1981 | MacGregor |
| 4,263,721 | A | 4/1981 | Danford |
| 4,301,817 | A | 11/1981 | Keritsis |
| 4,317,837 | A | 3/1982 | Kehoe et al. |
| 4,355,648 | A | 10/1982 | Bokelman et al. |
| 4,364,401 | A | 12/1982 | Keritsis |
| 4,424,024 | A | 1/1984 | Wilson et al. |
| 4,430,806 | A | 2/1984 | Hopkins |
| 4,470,422 | A | 9/1984 | Joubert et al. |
| 4,482,315 | A | 11/1984 | Day |
| 4,483,353 | A | 11/1984 | Mitchell |
| 4,499,911 | A | 2/1985 | Johnson |
| 4,556,073 | A | 12/1985 | Gravely et al. |
| 4,557,057 | A | 12/1985 | Weiss et al. |
| 4,557,280 | A | 12/1985 | Gravely et al. |
| 4,559,956 | A | 12/1985 | De Lange et al. |
| 4,566,469 | A | 1/1986 | Semp et al. |
| 4,572,219 | A | 2/1986 | Gaisch et al. |
| 4,590,954 | A | 5/1986 | Gooden |
| 4,620,556 | A | 11/1986 | Rosson et al. |
| 4,622,982 | A | 11/1986 | Gaisch et al. |
| 4,640,299 | A | 2/1987 | Ono et al. |
| 4,651,759 | A | 3/1987 | Uydess |
| 4,685,478 | A | 8/1987 | Malik et al. |
| 4,709,708 | A | 12/1987 | Kagawa |
| 4,709,710 | A | 12/1987 | Gaisch et al. |
| 4,756,317 | A | 7/1988 | Edwards |
| 4,788,989 | A | 12/1988 | Nambu et al. |
| 4,790,335 | A | 12/1988 | Marley et al. |
| 4,802,498 | A | 2/1989 | Ogren |
| 4,805,642 | A | 2/1989 | Rainer |
| 4,821,747 | A | 4/1989 | Stuhl et al. |
| 4,836,222 | A | 6/1989 | Livingston |
| 4,874,000 | A | 10/1989 | Tamol et al. |
| 4,898,189 | A | 2/1990 | Wochnowski et al. |
| 4,906,274 | A | 3/1990 | Mattox |
| 4,907,605 | A | 3/1990 | Ray et al. |
| 5,018,281 | A | 5/1991 | Bulluck, Jr. |
| 5,023,376 | A | 6/1991 | Shehad et al. |
| 5,125,420 | A | 6/1992 | Livingston |
| 5,127,934 | A | 7/1992 | Mattox |
| 5,139,035 | A | 8/1992 | Lasch et al. |
| 5,335,590 | A | 8/1994 | Crump, III et al. |
| 5,372,149 | A | 12/1994 | Roth et al. |
| 5,383,445 | A | 1/1995 | Dixon |
| 5,431,175 | A | 7/1995 | Beckett et al. |
| 5,488,962 | A | 2/1996 | Perfetti |
| 5,515,775 | A | 5/1996 | Crump, III et al. |
| 5,560,376 | A | 10/1996 | Meiring et al. |
| 5,685,710 | A | 11/1997 | Sagrera et al. |
| 5,791,353 | A | 8/1998 | Junemann et al. |
| 5,803,081 | A | 9/1998 | O'Donnell, Jr. et al. |
| 5,810,020 | A | 9/1998 | Northway et al. |
| 6,135,121 | A | 10/2000 | Williams |
| 6,202,649 | B1 | 3/2001 | Williams |
| RE38,123 | E | 5/2003 | Williams |
| 6,805,134 | B2 | 10/2004 | Peele |
| 6,895,974 | B2 | 5/2005 | Peele |
| 7,377,280 | B2 | 5/2008 | Bokelman et al. |
| 7,404,406 | B2 | 7/2008 | Peele |
| 2001/0000386 | A1 | 4/2001 | Peele |

FOREIGN PATENT DOCUMENTS

| | | |
|---|---|---|
| GB | 706052 | 3/1954 |
| GB | 1484663 | 9/1977 |
| GB | 2064294 | 6/1981 |
| GR | 86.2434 | 10/1986 |
| JP | 51-133495 | 11/1976 |
| JP | 53-069897 | 6/1978 |
| JP | 54-157898 | 12/1979 |
| JP | S56-19224 | 5/1981 |
| JP | S56-44707 | 10/1981 |
| JP | S58-104483 | 6/1983 |
| KR | 1994-00013396 | 7/1994 |
| WO | 94/07382 | 4/1994 |
| WO | 98/05226 | 2/1998 |
| WO | 98/58555 | 12/1998 |
| WO | 00/15056 | 3/2000 |

OTHER PUBLICATIONS

53rd Tobacco Science Research Conference, Montreal, Quebec, Canada, Program Booklet and Abstracts, vol. 53, pp. 68–69. (Sep. 12, 1999).

Adams, J.D. et al., Short Paper: *Tobacco–Specific N–Nitrosamines in Dry Snuff,* Fd Chem. Toxic., vol. 25, No. 3, pp. 245–246. (1987).

Aerovent XTM Curer brochure. (Sturgill 002321–002322; Sturgill–7) (1970s).

Abstracts by Peele, D.M., *Chemical and Biochemical Changes During the Flue–curing of Tobacco,* Bush, L., *Origin of Nitrite–Nitrogen for Tobacco–Specific N–nitrosamine formation,* Teague, R.V., *New Curing System for Fuel, Electricity and Labour Savings in Thailand,* Coresta Meet. Agro–Phyto Groups, pp. 146–148. (1995).

Andersen, R.A. et al., *Accumulation of 4-(N-Methyl-N-nitrosamino)-1-(3-pyridyl)-1-butanone in Alkaloid Genotypes of Burley Tobacco During Postharvest Processing: Comparisons with N' Nitrosonornicotine and Probable Nitrosamine Precursors,* Cancer Research, vol. 45, pp. 5287–5293. (1985).

Andersen, R.A. et al., *Changes in Chemical Composition of Homogenized Leaf-Cured and Air-Cured Burley Tobacco Stored in Controlled Environments.* American Chemical Society, J. Agric. Food Chem., vol. 30, pp. 663–668. (1982).

Andersen, R.A., et al., *Effects of Air-Curing Environment on Alkaloid Derived Nitrosamines in Burley Tobacco,* U.S. Department of Agriculture and College of Agriculture, University of Kentucky, Lexington, KY, pp. 451–455. (undated).

Atawodi, S.E. et al., *Tobacco-specific nitrosamines in some Nigerian cigarettes,* Cancer Letters, No. 97. pp. 1–6 (1995).

Becker, S., *$O_2$ as the Regulatory Signal for FNR-Dependent Gene Regulation in Escherichia coli,* J. Bacteriol., vol. 178, No. 15, pp. 4515–4521 (Aug. 1996).

Bhide, S.V. et al., *Tobacco -specific N-Nitrosamines [TSNA] in Green Mature and Processed Tobacco Leaves from India,* Beitrage zur Tabakforschung International, vol. 14, No. 1, pp. 29–32 (Dec. 1987).

Bhide, S.V. et al., *Tobacco-Secific N-Nitrosamines in Green Mature Tobacco Leaves and its Progressive Increase on Drying and Processing.* (undated).

Boyette, M.D. and C.W. Suggs, *Mechanization,* Flue-Cured Tobacco 1992 Information. (1992).

Brunnemann, K. et al., *Analytical Studies on N-Nitrosamines in Tobacco and Tobacco Smoke,* 45th Meeting of the Tobacco Chemists' Research Conference, Asheville, North Carolina, Recent Advances in Tobacco Science, vol. 17, pp. 71–112. (Oct. 1991).

Brunnemann, K. et al., *Analytical Studies on N-Nitrosamines in Tobacco and Tobacco Smoke,* Toxicology, vol. 21, issue 4, pp. 235–240. (1991).

Brunnemann, K. et al., *N-Nitrosamines in Chewing Tobacco: An International Comparison,* J. Agric. Food Chem., vol. 33, pp. 1178–1181. (1991).

Brunnemann, K. et al., *Role of Tobacco Stems in the Formation of N-Nitrosamines in Tobacco and Cigarette Mainstream and Sidestream Smoke,* American Chemical Society, J. Agric. Food Chem., vol. 31, No. 6, pp. 1221–1224. (1983).

Bunn, J.M., et al., *Environmental Design of a New Burley Curing Barn,* Tobacco Science, XVII, pp. 1–5. (Jun. 22, 1973).

Burton, H. et al., *Changes in Chemical Composition of Tobacco Lamina During Senescense and Curing. 1. Plastic Pigments,* J. Agric. Food Chem., vol. 33, pp. 879–883. (1985).

Burton, H. et al., *Distribution of Tobacco Constituents in Tobacco Leaf Tissue. 1. Tobacco-Specific Nitrosamines, Nitrate, Nitrite, and Alkaloids,* J. Agric. Food Chem., 40, p. 1050–1055. (1992).

Burton et al., *Influence of Temperature and Humidity on the Accumulation Tobacco-Specific Nitrosamines in Stored Burley Tobacco,* J. Agric. Food Chem., vol. 37, No. 5, pp. 1372–1377. (1989).

Burton, H. et al., *Relationship between Tobacco-Specific Nitrosamines and Nitrite from Different Air-Cured Tobacco Varieties,* J. Agric. Food Chem., vol. 42, No. 9, pp. 2007–2011. (1994).

Burton, H., *Influence of Rapid Drying of Dark Tobacco during Curing on the Accumulation of Tobacco-Specific Nitrosamines (TSNA) and Nitrite,* Progress Report submitted to Swedish Tobacco (1994).

Burton, H. et al., Abstract entitled *Reduction of Nitrite-Nitrogen and Tobacco N'-Specific Nitrosamines in air-cured tobacco by elevating drying temperatures,* CORESTA 1995.

Burton, H. overheads summarizing the 1993 Quick Drying, Freeze Drying and Microwave testing, presented at CORESTA 1995.

Burton, H. overheads summarizing the 1994 Quick Drying and Freeze Drying testing, presented at CORESTA 1995.

Carter et al., *Soil and Sediment Bacteria Capable of Aerobic Nitrate Respiration,* Appl. Environ. Microbiol., vol. 61, No. 8, pp. 2852–2858. (Aug. 1995).

Case, P.D. et al., *The Effect of Curing Techniques on the Nitrosamine Content of Tobacco: A Preliminary Study,* Group Research and Development Centre, Oct. 13, 1983.

Chamberlain et al., *Effects of Curing and Fertilization on Nitrosamine Formation in Bright and Burley Tobacco,* Phytochemical Research Unit, USDA, Agricultural Research Service, Beitrage zur Tabakforschung International, vol. 15, No. 2, pp. 87–92. (Apr. 1992).

Chamberlain et al., *Levels of N-nitrosonornicoltine in Tobaccos Grown under Varying Agronomic Conditions,* Tobacco International, vol. 186, No. 26, pp. 156–158 (1984).

Chamberlain et al., *Studies on the Reduction of Nitrosamines in Tobacco,* Tobacco International, vol. 188, No. 16, pp. 38–39. (1986).

Chamberlain, W.J., O.T. Choritk, J.L. Baker and T.G. Sutton, *Curing Effects on Contents of Tobacco-Specific Nitrosamines in Bright and Burley Tobaccos,* 41st TCRC, No. 53, 1987.

Cooper et al., *Drying and Curing Bright Leaf Tobacco with Conditioned Air,* Industrial Engineering Chemistry, vol. 32, pp. 194–198 (Feb. 1940).

Cui, M. et al., *Factors in Tobacco-Specific n-Nitrosamine Accumulation in Tobacco,* TCRC No. 5074, 1996, Philip Morris Conference InfoBase. (1996).

Cundiff, J. et al., *Energy Model for Forced Air Tobacco Curing,* Transactions of the ASAE, vol. 24, No. 1, pp. 211–215 (1981).

Cundiff, J.S., *Fan Cycling and Energy Consumption in Bulk Tobacco Curing,* The University of Georgia Agriculture Experiment Stations, Research Report 288, pp. 3–29. (Jul. 1978).

Cundiff, J.S., *Containerized Curing of Tobacco,* 1974 Winter Meeting of the American Society of Agricultural Engineers, Chicago, Illinois, Dec. 10–13, 1974, pp. 1–19. (Dec. 1974).

Cundiff, John S., *Effect of Exchange Air Rate on Energy Efficiency in Tobacco Curing,* 1980 Winter Meeting of the American Society of Agricultural Engineers, Chicago, Illinois, Dec. 2–5, 1980.

Davis, D. Layten and M.T. Nielsen (eds.), *Tobacco Production, Chemistry and Technology,* Blackwell Science Ltd., Oxford, UK., pp. 129 and 132 (undated).

Dixon, M. et al., *Enzymes,* Dixon, M. and Edwin C. Webb (eds), Second Edition, American Press, New York, pp. 144–151. (1964).

Djordjevic, M. et al., *Tobacco-Specific Nitrosamine Accumulation and Distribution in Flue-Cured Tobacco Alkaloid Isolines,* J. Agric. Food Chem., vol. 37, No. 3, pp. 752–756 (1989).

Djordjevic, M.V. et al., *Tobacco–Specific Nitrosamine Accumulation in Different Genotypes of Burley Tobacco at Different Stages of Growth and Air–Curing,* 41st Tobacco Chemists' Research Conference. (1987).

Duncan, George A., *Using Fans in Conventional Burley Barns,* University of Kentucky Cooperative Extension Service, AEN–69. (Apr. 1992).

Fischer, S. et al., *Exposure to Tobacco–specific Nitrosamines by the Different Habits of Tobacco Use, Examination of Transfer Rates and the Influence of Smoking Habits,* from website www.dkfz–heidelberg.de, printed Feb. 14, 2001.

Fischer, S. et al., *Investigations on the Origin of Tobacco Specific Nitrosamines in Mainstream Smoke of Cigarettes,* Carcinogenesis vol. 11, No. 5, pp. 723–730. (1990).

Fischer, S. et al., *No Pyrosynthesis of N'–Nitrosonornicotine (NNN) and 4–(Methylnitrosamino)–1–(3–Pyridyl)–1–Butanone (NNK) from Nicotine,* Advances in Pharmacological Sciences, pp. 103–107. (1995).

Fischer, S. et al., *Preformed Tobacco–Specific Nitrosamines in Tobacco Role of Nitrate and Influence of Tobacco Type,* Carcinogenesis, vol. 10, No. 8, pp. 1511–1517 (1989).

Fischer, S. et al. *Tobacco–Specific Nitrosamines in Canadian Cigarettes,* J. Cancer Res. Clin. Oncol., vol. 116, pp. 563–568. (1990).

Fischer, S. et al., *Tobacco–Specific Nitrosamines in European and USA cigarettes,* Archiv für Geschwulstforschung, vol. 60, No. 3, pp. 169–177. (1990).

Fisher, Brandy, *Curing the TSNA Problem,* Tobacco Reporter. (Aug. 2000).

Frankenburg, W.G., *Chemical Changes in the Harvested Tobacco Leaf,* Advances in Enzymology, vol. X, pp. 326–425 (1950).

Garvin, R.T., *How Prolonged Yellowing Affects the Dry–Mass Yield And Chemical Constituents of Flue–Cured Tobacco,* Tobacco Science, vol. 32, pp. 13–15. (May 2, 1986).

Gondwe, W. et al., *Screening Tobacco Types, Cultivars and Curing Methods for Low Nitrosamine Tobacco Production in Malawi,* Agricultural Research and Extension Trust, 1996 Coresta Congress, Yokohama, Japan, Nov. 3–8, 1996, pp. 1–7. (Nov. 1996).

Hamilton, J.L. et al., *Nitrate Concentration Changes During Senescence and Air Curing of Burley Tobacco,* Tobacco International, vol. 184, No. 24, pp. 44–48. (Jun. 24, 1981).

Hecht, S. et al., *Tobacco–Specific Nitrosamines: Formation From Nicotine in vitro and During Tobacco Curing and Carcinogenicity in Strain A Mice,* J. Natl. Cancer Inst., vol. 60, No. 4, 819–824. (Apr. 1978).

Hecht, S. et al., *Chemical Studies on Tobacco Smoke. XXXIII. N–Nitrosononicotine Tobacco: Analysis of Possible Contributing Factors and Biologic Implications,* J. Natl. Cancer Inst., vol. 54, No. 5, 1237–1244. (May 1974).

Hecht, S.S., *Biochemistry, Biology, and Carcinogenicity of Tobacco–Specific N–Nitrosamines,* Chem. Res. Toxicology, vol. 11, No. 6, pp. 559–603. (Jun. 1, 1998).

Henson et al., *Yellowing Flue–Cured Tobacco in the Bulk, Tobacco Science,* vol. 2, No. 11, pp. 23–28 (Mar. 14, 1958).

Hoffman, D. et al., *Carcinogenic Tobacco–specific N–Nitrosamines in Snuff and in the Saliva of Snuff Dippers,* Cancer Research, 43, 4305–4308 (Nov. 1981).

Hoffman, D. et al., *The Role of Volatile and Novolatile N–Nitrosamines in Tobacco Carcinogenesis,* Naylor Dana Inst. For Disease Prevention, American Health Foundation, Valhalla, New York, pp. 113–127. (1980).

Hoffman, Dietrich, Abraham Rivenson, Fung–Lung Chung, and Stephen S. Hecht, *Nicotine Derived N–Nitrosamines (TSNA) and Their Relevance in Tobacco Carcinogenesis,* Critical Reviews in Toxicology, vol. 21, No. 4, 1991, pp. 305–311 and handwirtten notes. (1991).

Hoffman, D. et al., *Nicotine derived N–Nitrosamines and Tobacco related Cancer: Current Status and Future Directions,* Cancer Research, vol. 45, 935–944. (Mar. 1985).

Johnson, *Curing,* Rec. Adv. Tob. Sci. Inaugural Vol., pp. 63–68 (1974).

Johnson, W.H. *Bulk Curing of Bright Leaf Tobacco,* Tobacco Science, vol. 4, pp. 49–55. (1966).

Johnson, W.H., *Oxygen Depletion By Respiration For Bright Leaf Tobacco In A Closed Curing System,* Tobacco Science, pp. 5–11. (1965).

Johnson, W.H., *Influence of Harvesting and Process Variables on Bulk Curing Of Bright Leaf Tobacco,* Transactions of the American Society of Agricultural Engineers, vol. 8, No. 3, pp. 354–357. (1965).

Johnson, W.H., *Rapid Drying of Yellowed Flue–Cured Tobacco,* Tobacco Science, 40(2):58–68. (Jun. 1996).

Larsson, B.K. et al., *Polycyclic Aromatic Hydrocarbons and Volatile N–Nitrosamines in Some Dried Agricultural Products,* Swedish Journal of Agricultural Res., vol. 20, No. 2, pp. 49–56. (1990).

Legg, P.D. et al., *Nitrogenous Constituents in Dark Air–Cured and Fire–Cured Cultivars,* TCRC, No. 4009, Phillip Morris Conference InfoBase. (1986).

MacKown, C.T. et al., *Tobacco–Specific N–Nitrosamines: Effect of Burley Alkaloid Isolines and Nitrogen Fertility Management,* J. Agric. Food Chem. 32, No. 6, pp. 1269–1272. (1984).

MacKown, C.T. et al., *Tobacco–Specific N–Nitrosamines: Formation During Processing of Midrib and Lamina Fines,* J. Agric. Food Chem. vol. 36, pp. 1031–1035. (1998).

Makleit, S., *Nitrosamines in Tobacco and In Cigarette Smoke,* vol. 2, pp. 44–47 (Translated Publication). (1986).

Matkin, D.A. et al., *Nitrosamine Reduction By Tobacco Irradiation,* (U.K. & Export) Ltd., Research & Development Centre, pp. 1–21. (Mar. 1, 1989).

Matkin, D.A. et al., *The Effects of Agricultural and Curing Practices on Nitrosamine Levels in Tobacco,* (U.K. & Export) Ltd., Research & Development Centre. (Jun. 11, 1986).

Maw, B.W. et al., *Tobacco Quality As Affected By Fan Cycling During Different Stages of Tobacco Curing,* Tobacco Science, vol. 30, pp. 116–118, 1986.

Mende, P. et al., *Occurrence of the Nitrosamide Precursor Pyrrolidin–(2)–One in Food and Tobacco,* Carcinogenesis vol. 15, No. 4, pp. 733–737. (1994).

Mingwu, C. et al., *Effect of Maleic Hydrazide Application on Accumulation of Tobacco–Specific Nitrosamines in Air–Cured Burley Tobacco,* J. Agric. Food Chem. vol. 42, No. 12, pp. 2912–2916 (1994).

Mingwu, C., *The Source and the Regulation of Nitrogen Oxide Production for Tobacco–Specific Nitrosamine Formation,* 178 pages, Avail., UMI, Order No. DA9907718 from: Diss. Abstr. Int., B, 59(9), 4548 Dissertation. (Jun. 14, 1998).

Moreno–Vivian et al., *Procaryotic Nitrate Reduction: Molecular Properties and Functional Distinction Among Bacterial Nitrate Reductases,* vol. 181, No. 21, pp. 6573–6584. (Nov. 1999).

Morin, A. et al., *Evolution of Tobacco Specific Nitrosamines and Microbial Populations During Flue–Curing of Tobacco Under Direct and Indirect Heating,* Contributions to Tobacco Research, vol. 21, No. 1, pp. 40–46. (Mar. 2004).

Morin, A. et al., *Relationship Between Tobacco–Specific Nitrosamines (TSNA) and Microbial Populations from Ontario–Grown Tobacco Flue–Cured Under Direct and Indirect Heating,* Imperial Tobacco Canada Limited Canada Limited. (May 4, 2000).

Nestor, T.B. et al., *Role of Oxides of Nitrogen in Tobacco–Specific Nitrosamine Formation in Flue–Cured Tobacco,* Beitrage zur Tabkforschung International, vol. 20, No. 7, pp. 467–475 (Nov. 2003).

Oshima, H. et al., *Identification and Occurrence of Two New N–Nitrosamino Acids in Tobacco Products: 3–(N–Nitroso N–Mehtylamino) Propionic Acid and 4–(N–Nitroso–N–Methylamino) Butyric Acid,* Cancer Letters, vol. 26, pp. 153–162. (1985).

Peedin, G.F., *Chapter 5: Production Practices,* Tobacco: Production, Chemistry, and Technology, ed. D. Layten Davis and Mark T. Nielsen, Blackwell Sciences, Ltd. (1999).

Peele, D.M. et al., *Formation of Tobacco Specific Nitrosamines in Flue–Cured Tobacco.* (undated).

Qungang, Q., Information Bulletin, Cooperation Centre for Scientific Research Relative to Tobacco (CORESTA), Abstr.–Ref. 6210–6646, pp. 7–22, 1991–1992 (Sep. 1999).

Ralt, D. et al., *The Role of Bacteria in Nitrosamine Formation,* American Chemical Society, pp. 157–164. (Aug. 10, 1981).

Risner, C.H. and F.N. Wendelboe, *Quantification of Tobacco–Specific Nitrosamines in Tobacco,* Tobacco Science, vol. 38, pp. 1–6. (Jan. 1994).

Ryan et al., *A Tobacco Curing Energy Model,* Conference on Agricultural Engineering 1988, Hewksbury Agricultural College, NSW Sep. 25–29, 1988.

Schlotzhauer, W.S. et al., *Changes in the Chemical Composition of NC 2326 Tobacco Through Ozone Treatment of Intact Leaves,* Tobacco Science, vol. 31, pp. 57–60. (Oct. 1987).

Sisson, V., *The Nicotiana Catalogue, Compilation of International Tobacco Germplasm Holdings,* Cooperation Centre for Scientific Research Relative to Tobacco (CORESTA). (Jun. 20, 1998).

Spiegelhalder, B. et al., *Formation of Tobacco–Specific Nitrosamines,* B., Critical Reviews in Toxicology 21, No. 4, p. 241. (1991).

Spiegelhalder, B. et al., *Tobacco–specific nitrosamines,* European Journal of Cancer Prevention, vol. 5 (Supplement I), pp. 33–38. (1996).

Spiegelhalder, B., *A Method for the Determination of Tobacco–specific Nitrosamines (TSNA), Nitrate and Nitrite in Tobacco Leaves and Processed Tobacco,* Beitrage zur Tabakforschung International, vol. 14, No. 3, pp. 135–144. (Jan. 1989).

Stehlik, G. et al., *Concentration of Dimethylnitrosamine in the Air of Smoke Filled Rooms,* Ecotoxicology and Environmental Safety, No. 6, pp. 495–500. (1982).

Suggs, C.W., *Dry Matter and Mosture Loss of Bright Leaf Tobacco During Curing,* Tobacco Science 9, pp. 28–33. (Feb. 15, 1989).

Suggs, C.W. et al., *Bulk Density and Drying Effect on Air Flow Through Flue–Cured Tobacco Leaves,* vol. 33, pp. 86–90. (Feb. 24, 1989).

Suggs, C.W., *Mechanical Harvesting of Flue Cured Tobacco: Part 10: Optimization of Curing Capacity and Bulk Barn Parameters,* Tobacco Science, vol. 23, pp. 126–130. (May 2, 1979).

Suggs, C.W., *Mechanical Harvesting of Flue–Cured Tobacco: Part 9: Developments in Container (Box) Bulk Curing,* Tobacco Science, vol. 23, pp. 1–6./ (Jul. 18, 1979).

Matuo, S. and M. Tetsuji, *Wide Area Perfect Cooperative Drying,* Leaf Tobacco Research, No. 111, pp. 10–19, including translation attached to Japanese language version. (Oct. 1989).

Sumner, J.E. and J.S. Cundiff, *Guidelines for Temperature, Humidity, and Airflow Control in Tobacco Curing,* University of Georgia College of Agriculture Experiment Stations, Research Bulletin 299. (May 1983).

Tricker, A.R. et al., *The Occurrence of N–Nitro Compounds in Zarda Tobacco,* Cancer Letters, vol. 42, pp. 113–118. (1988).

Tricker, A.R. et al., *The Occurrence of N–nitroso Compounds in Kiwam tobacco,* Cancer Letters, vol. 49, pjp. 221–224. (1989).

Tricker, A.R., R. Haubner, B. Spiegelhalder and R. Preussmann, *The Occurrence of Tobacco–Specific Nitrosamines in Oral Tobacco Products and Their Potential Formation Under Simulated Gastric Conditions,* Fd. Chem. Toxic. vol. 26, No. 10, pp. 861–865. (1988).

Tso, T.C. et al., *Some Agronomic Factors Affecting N–Dimethyl Nitrosamine Content in Cigarette Smoke,* Beitrage zur Tabakforschung, vol. 8, No. 1, pp. 34–38. (Jan. 1975).

Walker, E.K., *Bulk Curing Studies with Flue–Cured Tobacco,* Lighter, vol. 32, pp. 25–31. (1962).

Walker, E.K., *Effect of Relative Humidity in Yellowing Flue–Cured Tobacco Under Forced–Air Conditions,* Lighter, vol. 35, pp. 16–21. (1965).

Zumft, W.G., *Cell Biology and Molecular Basis of Denitrification,* Microb. Mol. Biol. Rev., vol. 61, No. 4, pp. 533–616. (Dec. 1997).

TSNA sample date from Sep. 1, 1998–Sep. 23, 1998. (DDX 7) (Sep. 1998).

TSNA sample data from Sep. 1, 1998–Sep. 23, 1998 (DDX 8) (Sep. 1998).

TSNA sample data from Sep. 1, 1998–Nov. 12, 1998 (DDX 55) (Dec. 1998).

TSNA sample data (1996–1998) (PDX 190).

TSNA sample data (Mar. 2001) (DDX 27).

Brochure entitled *IF Series Indirect Fired* from Dayco, Inc. (undated).

Manual entitled *Powell Manufacturing, Co.'s "77–514" and "77–771" Erection Instructions,* Sep. 10, 1970.

Manual entitled *Powell Manufacturing, Co. Bulk Curing Owner/Operators Manual,* Jan. 17, 1979.

Manual entitled *Powell Manufacturing, Co.'s Bulk Curing/Drying Owner's/Operator's Manual for Flue Cured Tobaccos,* Powell Manufacturing, Co. (Jan. 20, 1988).

Manual entitled *Powell Manufacturing, Co. Bulk Curing Tobacco Barn Owner/Operator Manual,* Powell Manufacturing, Co., Feb. 1, 1992.

Manual entitled *Ventobacco Company 84 Rack Curing Barn,* Ventobacco Company, Jordan, 1992.

Manual entitled *Ventobacco Company Ventolab 6 Operator's Manual,* Ventobacco Company, Cyprus, 1992.

Manual entitled *Ventobacco Company Bulk Curing Barns Operator's Manual,* Ventobacco Company, Poland, 1993.
Manual entitled *Ventobacco Company Curing Computer VK 961 Operator's Manual,* 1997.
Brochure entitled *Long Manufacturing Company Generation II Easi–Cure Tobacco Barn* (BAW–017853–7) (undated).
Brochure entitled *Long Manufacturing Company Generation II Easi–Cure Tobacco Barn* (RCT–001656–9) (undated).
Manual entitled *VCU Ventobacco Company Curing Unit,* Ventobacco Company (1999).
Manual entitled *Ventobacco Company Curing Computer VK 981 Operators Manual,* 1998.
Product specifications for *Direct Drive Tubeaxial Fans from Aerovent, Inc.* (undated).
Parsons, L.L., Smith, M.S., Hamilton, J.L., and Mackown, C.T., "*Nitrate Reduction During Curing and Processing of Burley Tobacco,*" Tobacco Science 100, (Sep. 5, 1986), pp. 48–52.
American Society of Agricultural Engineers, *Exchanged Air Control for Maximum Solar Energy Utilization in Tobacco Curing,* pp. 260–264, 1983.
Walker, E.K., *Fixing the Color of Flue–Cured Tobacco Under Forced Air Conditions,* Tobacco Science, 1–7 (1965).
H.R. Burton et al., "Changes in Chemical Composition of Burley Tobacco during Senscence and Curing. 3. Tobacco Specific Nitrosamines", J. Agric. Food Chem., 1989, 37, pp. 426–430.
Program 49th Tobacco Chemists' Research Conference, 1995, vol. 49, Lexington, Kentucky, p. 38.
Technology Agriculture, 1995, pp. 146–148.
W.J. Chamberlain et al., Levels of N–nitrosonornicotine in Tobaccos Grown Under Varying Agronomic Conditions, Tobacco International, (1984) vol. 186, No. 26, pp. 111–113.
Book entitled *Drying Farm Crops,* Carl W. Hall, Agricultural Consulting Associates, Inc. (1957).
DeCloet Bulk Curing Kilns. (Apr. 1971).
Cundiff, J.S. *Exchanged Air Control for Maximum Solar Energy Utilization in Tobacco Curing,* American Society of Agricultural Engineers, John S. Cundiff, vol. 26, No. 1 pp. 260–264 (1983).
Suggs, C.W. et al., *Pressure versus air flow through fresh tobacco leaves,* American Society of Agricultural Engineers, Transactions of ASAE, vol. 28, No. 5, pp. 1664–1667. (1985).
Manual entitled *Powell Manufacturing, Co. Bulk Curing/ Drying Owner's/Operator's Manual for Flue Cured Tobacco,* Powell Manufacturing, Co. (Jan. 20, 1988).
Skillman, Laura, Messenger–Inquirer article entitled, *Glenn Farm Tests Swedish Method for Curing Tobacco.* (Aug. 5, 1990).
Abstracts presented at Coresta Agronomy & Phytopathology Meeting, Louisville, Kentucky. (Oct. 15, 1991–Oct. 18, 1991).
Presentation entitled *Model For Flue Cured Production in Greece,* Presented at Coresta Agronomy & Phytopathology Meeting, Louisville, Kentucky by Hadzistavros, S.C. et al. (Oct. 17, 1991).
Manual entitled *Vencon Varsos SA Three Tier Barn Assembly Manual.* (1992).
Manual entitled *Ventolab 6, 1993 Model, Operator's Manual.* (1993).
Manual entitled *Ventobacco Company Ventolab 6 Operator's Manual,* Ventobacco Company, Turkey 1993.
Manual entitled *Ventobacco Company Ventolab 6 1993 Model Operator's Manual,* Ventobacco Company (1993).
Manual entitled *Ventobacco Company Bulk Curing Barns Operator's Manual,* Ventobacco Company, Turkey 1993.
Manual entitled *Ventobacco Company Ventolab 6 operator's manual,* Ventobacco Company, U.S.A. 1994.
Manual entitled *Ventobacco Company Ventolab 6 Operator's Manual,* Ventobacco Company, U.S.A. 1994 (DTX–2356).
Manual entitled *Ventobacco Company Bulk Curing Barns Operator's Manual,* Ventobacco Company, Jordan 1994.
Manual entitled *Ventobacco Company Ventolab 6 operator's manual,* Ventobacco Company, U.S.A. 1994 (DTX–1869).
Slide presentation entitled *Chemical and Microbiological Changes During Flue Curing of NK–149 Tobacco,* Presented at 48$^{th}$ Tobacco Chemists Research Conference, Greensboro, NC by Jackie Greene and William Caldwell. (Sep. 27, 1994) (DTX–0014).
Slide presentation entitled *Chemical and Microbiological Changes During Flue Curing of NK–149 Tobacco,* Presented at 48$^{th}$ Tobacco Chemists Research Conference, Greensboro, NC by Jackie Greene and William Caldwell. (Sep. 27, 1994) (DTX–0015).
Slide presentation entitled *Chemical and Microbiological Changes During Flue Curing of NK–149 Tobacco,* Presented at 48$^{th}$ Tobacco Chemists Research Conference, Greensboro, NC by Jackie Greene and William Caldwell (Sep. 27, 1994) (DTX–0016).
Slide presentation entitled *Chemical and Microbiological Changes During Flue Curing of NK–149 Tobacco,* Presented at 48$^{th}$ Tobacco Chemists Research Conference, Greensboro, NC by Jackie Greene and William Caldwell (Sep. 27, 1994) (DTX–0017).
Slide presentation entitled *Chemical and Microbiological Changes During Flue Curing of NK–149 Tobacco,* Presented at 48$^{th}$ Tobacco Chemists Research Conference, Greensboro, NC by Jackie Greene and William Caldwell (Sep. 27, 1994) (DTX–2343).
Manual entitled *Ventobacco Company Bulk Curing Barns Operator's Manual,* Ventobacco Company. (1995).
Long Generation II Easi–Cure Tobaco Barn Advertisement in May 15, 1995 issue of Flue Cured Tobacco (May 15, 1995).
Walker, E.K. et al., *Curing Flue–Cured Tobacco in Canada.* Research Station, Delhi, Ontario (1997).
Manual entitled *Ventobacco Company Curing Computer VK 961 Operator's Manual,* Ventobacco Company. (1997).
Manual entitled *Ventobacco Company Bulk Curing Barns Operator's Manual,* Ventobacco Company, China 1997.
TSNA analysis of Chinese cigarettes dated Aug. 20, 1997 performed by Harold Burton.
Program of 1997 Agro–Phyto Meeting, Montreux, Switzerland. (Oct. 6, 1997–Oct. 9, 1997).
Slide presentation entitled *The Role of Nitrite in The Accumulation of TSNAs In Tobacco,* Presented at 1997 Agro–Phyto Meeting, Montreux, Switzerland. (Oct. 6, 1997).
Manual entitled *Vencon–Varsos SA Ventobacco Company Bulk Curing Barns Operator's Manual,* Ventobacco Company, Turkey (1998).
Manual entitled *Vencon–Varsos SA Ventobacco Company Bulk Curing Barns Operator's Manual,* Ventobacco Company, Poland (1998).

Abstract entitled *Airflow in Big Box Flue Cured Tobacco Barns,* David Peele, Coresta, 1998. (Mar. 31, 1998).
Manual entitled *Ventobacco Company Bulk Curing Barns Operator's Manual,* Ventobacco Company, USA 1999.
Press release entitled *R.J. Reynolds Tobacco Company Tobacco Discloses Potential Method to Reduce Controversial Compounds in Flue-cured Tobacco.* (Apr. 29, 1999).
Program of the 1999 Meeting of the Smoke and Technology Study Groups, Innsbruck, Austria, Sep. 5–9, 1999 (Sep. 5, 1999–Sep. 9, 1999).
Abstracts of Presentations Made at the 1999 Coresta Joint Meeting of the Smoke and Technology Study Groups (Sep. 5, 1999–Sep. 9, 1999).
Slide presentation entitled *The Development of Low TSNA Air-Cured Tobaccos, II. Effects of Curing Conditions and Post-Curing Drying on TSNA Formation* Presented by R. Long, I. Wahlber, P. Brandt, and A. Wiernick at the 1999 Coresta Joint Meeting of the Smoke and Technology Study Groups, Innsbruck, Austria. (Sep. 6, 1999).
Slide presentation entitled *Formation of Tobacco Specific Nitrosamines in Flue-Cured Tobacco,* delivered by David Peele on Sep. 6, 1999 in Innsbruck, Austria, Sep. 15, 1999 in Montreal, Canada, and Oct. 13, 1999 in Suzhou, China (Sep. 6, 1999–Oct. 13, 1999).
Fax from Harold Burton to Jerome Jaffe, dated Nov. 5, 1999, including a 1999 publication entitled: *Smokeless Tobacco* by Inger Walhberg.
Photograph of crops drying building on Spindletop farm taken on Sep. 4, 2002.
David M. Peele, "Chemical and Biochemical Changes During the Flue-Curing of Tobacco," Recent Advances in Tobacco Science, vol. 21, Symposium Proceedings, Tobacco Chemists' Research Conference, 49$^{th}$ Meeting, Sep. 24–27, 1995 (pp. 80–133).
Willie Denton, Mgr., Long Equip. Co., "Generation II Easi-Cure Tobacco Barn [product information]," Tarboro, NC., 1998 (4 pages).
Hackh's Chemical Dictionary (3$^{rd}$ ed.), Julius Grant, M.Sc, PhD., F.R.I.C. (ed.), Definition of "anaerobic," The McGraw-Hill Book Company, Inc., p. 54 (1944).
Webster's Ninth New Collegiate Dictionary, Merriam Webster Inc., Definitions of "anaerobic," "formation" and "prevent," pp. 82, 485, 933 (1986).
"Farmtrac may be sold: South Korean firm makes offer," Business Week, from The Daily Southerner, Tarboro, NC, Dec. 29, 2008 (4 pages).
Bob Benedetti, "Farmtrac tries to regroup," The Daily Southerner, Tarboro, NC, Jan. 18, 2008 (2 pages).
Bob Benedetti, "Farmtrac tries to regroup," The Daily Southerner, Tarboro, NC, Dec. 29, 2008 (2 pages).
Richard N. Loeppky and Christopher J. Michejda (eds.), "Nitrosamines and Related N-Nitroso Compounds," developed from a symposium sponsored by the Division of Agricultural and Food Chemistry at the 204$^{th}$ National Meeting of the American Chemical Society, Washington, D.C.. Aug. 23–28, 1992, ACS Symposium Series, vol. 553 (7 pages).
Wiernik et al., "Effect of Air-Curing on the Chemical Composition of Tobacco," Recent Advances in Tobacco Science, vol. 21, Symposium Proceedings, Tobacco Chemists' Research Conference, 49$^{th}$ Meeting, Sep. 24–27, 1995 (pp. 38–81).
Scanlan et al., "N-Nitrosodimethylamine in Nonfat Dry Milk," Chapter 3, Oregon State University, Corvallis, OR, American Chemical Society (1994).
Willie Denton, Mgr., Long Equip. Co., "Generation II Easi-Cure Tobacco Barn [product information]," Tarbobo, NC., 1998 (4 pages).

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 41 is confirmed.

Claims 1-40 and 42-64 were not reexamined.

* * * * *